US009127671B2

(12) United States Patent
Ono et al.

(10) Patent No.: US 9,127,671 B2
(45) Date of Patent: Sep. 8, 2015

(54) OIL PUMP INCLUDING ROTORS THAT CHANGE ECCENTRIC POSITIONAL RELATIONSHIP ONE-TO ANOTHER TO ADJUST A DISCHARGE AMOUNT

(75) Inventors: Hisashi Ono, Okazaki (JP); Masaharu Hamasaki, Nagoya (JP); Yuki Nishida, Kariya (JP); Koji Nunami, Obu (JP); Shinji Kazaoka, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 726 days.

(21) Appl. No.: 12/933,912

(22) PCT Filed: Jul. 22, 2009

(86) PCT No.: PCT/JP2009/063118
§ 371 (c)(1),
(2), (4) Date: Sep. 22, 2010

(87) PCT Pub. No.: WO2010/013625
PCT Pub. Date: Feb. 4, 2010

(65) Prior Publication Data

US 2011/0014078 A1 Jan. 20, 2011

(30) Foreign Application Priority Data

Aug. 1, 2008 (JP) ..... 2008-199748

(51) Int. Cl.
*F04C 2/10* (2006.01)
*F04C 2/08* (2006.01)
(Continued)

(52) U.S. Cl.
CPC ..... *F04C 2/102* (2013.01); *F04C 2/086* (2013.01); *F04C 14/226* (2013.01); *F04C 14/08* (2013.01)

(58) Field of Classification Search
USPC ..... 418/24, 26–27, 30, 166, 171, 19
See application file for complete search history.

(56) References Cited

U.S. PATENT DOCUMENTS 4,097,204 A * 6/1978 Palmer ..... 418/19
4,413,960 A 11/1983 Specht
(Continued)

FOREIGN PATENT DOCUMENTS

DE 4231690 A1 3/1994
EP 846861 A1 6/1998
(Continued)

OTHER PUBLICATIONS

English machine translation of JP 08-159046 (translated on Dec. 2, 2014).*
(Continued)

*Primary Examiner* — Kenneth Bomberg
*Assistant Examiner* — Paul Thiede
(74) *Attorney, Agent, or Firm* — Buchanan Ingersoll & Rooney PC

(57) ABSTRACT

An oil pump includes: an inner rotor rotatable with a drive shaft in a unified manner on a drive-rotation axis; an outer rotor which has inner teeth configured to engage with outer teeth of the inner rotor and is rotatable about a driven axis eccentric to the drive-rotation axis; and an adjustment ring for rotatably supporting the outer rotor. A guide means which allows the adjustment ring to rotate about the driven axis, while allowing the driven axis to revolve about the drive-rotation axis, is formed of: first and second arm portions provided on the adjustment ring; and first and second guide faces with which the first and second arm portions are brought into slidable contact.

12 Claims, 11 Drawing Sheets

(51) Int. Cl.
*F04C 14/08* (2006.01)
*F04C 14/22* (2006.01)

(56) References Cited

U.S. PATENT DOCUMENTS

| | | | | |
|---|---|---|---|---|
| 4,492,539 | A * | 1/1985 | Specht | 418/19 |
| 4,887,956 | A * | 12/1989 | Child | 418/20 |
| 6,126,420 | A | 10/2000 | Eisenmann | |
| 7,637,725 | B2 * | 12/2009 | Berger | 418/61.3 |
| 2006/0088431 | A1 * | 4/2006 | Berger | 418/19 |
| 2009/0116989 | A1 | 5/2009 | Ono et al. | |

FOREIGN PATENT DOCUMENTS

| | | | |
|---|---|---|---|
| EP | 1927752 | A1 | 6/2008 |
| JP | 59-134392 | A | 8/1984 |
| JP | 1-83194 | U | 6/1989 |
| JP | 8-159046 | A | 6/1996 |
| JP | 9-264494 | A | 10/1997 |
| JP | 10-169571 | A | 6/1998 |
| JP | 2000-303965 | A | 10/2000 |
| JP | 2007-303457 | A | 11/2007 |
| JP | 2008-298026 | A | 12/2008 |
| WO | 2005/019650 | A1 | 3/2005 |

OTHER PUBLICATIONS

International Search Report (PCT/ISA/210) issued on Oct. 6, 2009, by Japanese Patent Office as the International Searching Authority for International Application No. PCT/JP2009/063118.

Written Opinion (PCT/ISA/237) issued on Oct. 6, 2009, by Japanese Patent Office as the International Searching Authority for International Application No. PCT/JP2009/063118.

Notification of Transmittal of Translation of the International Preliminary Report on Patentability (Form PCT/IB/338), International Preliminary Report of Patentability (Form PCT/IB/373), and Written Opinion of the International Searching Authority (Form PCT/ISA/237) dated Mar. 29, 2011, issued in corresponding International Patent Application No. PCT/JP2009/063118 by the International Bureau of WIPO.

Chinese Notification of Second Office Action dated Jun. 18, 2013 issued in the corresponding Chinese Patent Application No. 200980110187.8 and English language translation.

European Search Research Report issued on Oct. 7, 2013, by the European Patent Office in corresponding European Patent Application No. 09802868.1. (10 pages).

* cited by examiner

OIL PUMP INCLUDING ROTORS THAT CHANGE ECCENTRIC POSITIONAL RELATIONSHIP ONE-TO ANOTHER TO ADJUST A DISCHARGE AMOUNT

TECHNICAL FIELD

The present invention relates to an oil pump, and particularly to an oil pump having a structure in which an outer rotor having inner teeth and an inner rotor having outer teeth are engaged with each other in an eccentric state, which pump is configured to adjust a discharge amount by changing an eccentric positional relationship.

BACKGROUND ART

As the oil pump having the configuration described above, Patent Document 1 discloses an oil pump having an inner rotor 3 configured to be driven-rotated, and an outer rotor 4 which is configured to engage with outer teeth of the inner rotor 3 and disposed at an eccentric position to the inner rotor 3. The outer rotor 4 is rotatably supported on an inner periphery of a cam ring 5, and the cam ring 5 is supported by a support pin 10 swingably in a radial direction and at the same time movably in a direction to a center of an internal circle. A biasing force of a spring 7 is allowed to act on the cam ring 5 so that a volume of a transported oil pooling portion 11 of a suction region 21 becomes the maximum.

By the action of the biasing force of the spring 7, a control pressure chamber 20 is formed between the cam ring 5 and a pump body 1, and an oil pressure of a discharge outlet 17 is allowed to act on the control pressure chamber 20. When the pressure in the discharge outlet 17 is increased, the cam ring 5 is swingably moved in the radial direction by the pressure, and by this swingable movement, a position of a rotation center of the outer rotor 4 is allowed to revolve with a tooth height of an internal gear pump as a revolution diameter.

Also in Patent Document 1, by the revolution of the outer rotor 4, the volume of the transported oil pooling portion 11 is allowed to change which is formed by the outer teeth of the inner rotor 3 and the inner teeth of the outer rotor 4 on a terminal vicinity 22 of the suction region 21 of the pump body 1, and as a consequence, the adjustment of the discharge amount is realized.

As another oil pump having the configuration described above, Patent Document 2 discloses an oil pump in which an inner rotor 3 and an outer rotor 4 are eccentrically arranged, and a ring gear actuation set 5 is disposed therebetween. The outer rotor 4 is rotatably supported on an inner periphery of an adjustment ring 14, and an outer teeth line 24 is formed in an outer periphery of the adjustment ring 14. An inner teeth line 24' is formed in an inner periphery of a casing portion 1 or a press-cut ring 27, and the inner teeth line 24' and the outer teeth line 24 are eccentrically arranged.

In the casing portion 1, a rocker lever configured to actuate the adjustment ring 14 is swingably supported, and by swinging the rocker lever, a rotational axis of the outer rotor 4 is moved at an angle of 90 degrees to an opposite side in the inner rotor 3, while the inner teeth line 24' and the outer teeth line 24 are engaged with each other. With this movement, a positional relationship of the ring gear set 5 of the inner rotor 3 and the outer rotor 4 relative to a low-pressure port 8 and a high-pressure port 9 is changed, and the discharge amount of the pump can be adjusted between the maximum and zero.

Patent Document 1: Japanese Unexamined Patent Application Publication No. 8-159046 (paragraphs [0012]-[0028] and FIGS. 1-4)

Patent Document 2: Japanese Unexamined Patent Application Publication No. 10-169571 (paragraphs [0030]-[0046] and FIGS. 1-3)

SUMMARY OF INVENTION

In the case of the pump in which the adjustment of the discharge amount is performed by changing an eccentric positional relationship between the inner rotor and the outer rotor, the discharge amount can be changed between the maximum to nearly zero, without changing the rotational rate of the drive shaft. Especially in the filed of automobile, effective utilization of this type of pump has been demanded, since the discharge amount has to be adjusted to a large degree depending on an operational status and oil temperature.

However, in the pump having the configuration described in Patent Document 1, though the biasing force of the spring is allowed to act, accuracy in the engagement between the outer teeth of the inner rotor and the inner teeth of the outer rotor is expected to become poor, since the cam ring is supported movable inward and outward and swingable in the direction of the center of the internal circle.

In other words, in the form of actuation by the configuration of Patent Document 1, the outer rotor moves along the outer periphery of the inner rotor with the outer teeth of the inner rotor and the inner teeth of the outer rotor being engaged with each other, but no guide members or the like for regulating an axis of the outer rotor is provided. From this reason, a phenomenon is anticipated that a depth of engagement between the outer teeth of the inner rotor and the inner teeth of the outer rotor fluctuates.

Especially, in this type of the pump, a high pressure acts on between the outer teeth of the inner rotor and the inner teeth of the outer rotor. Therefore, in the case of the pump in which the cam ring is movable inward and outward, a relative positional relationship between the inner rotor and the outer rotor may be fluctuated due to a high pressure generated between the outer teeth of the inner rotor and the inner teeth of the outer rotor.

In the pump having the configuration described in Patent Document 2, the outer teeth line is formed in the outer periphery of the adjustment ring supporting the outer rotor, and the inter teeth line is formed in the casing supporting the adjustment ring. While retaining this engagement state between the outer teeth line and the inner teeth line, the adjustment ring is actuated. With this configuration, when the outer rotor is revolved about the inner rotor like in Patent Document 1, each positional relationship can be retained with high accuracy. However, there is room for improvement, since this configuration leads to growth in size, and processing technique with high accuracy is required in order to form the outer teeth line and the inner teeth line.

An object of the present invention is to provide a compact oil pump in which a discharge amount can be adjusted by changing an eccentric positional relationship between the inner rotor and the outer rotor.

SOLUTION TO PROBLEM

In one aspect of the present invention, there is provided an oil pump which includes in a casing: an inner rotor which has outer teeth and is configured to be driven about a drive-rotation axis; an outer rotor which has more inner teeth than a number of the outer teeth of the inner rotor and is configured to engage with the inner rotor in an eccentric state; a suction inlet and a discharge outlet configured to suck and discharge a fluid, each provided so as to face a space between the outer teeth and the inner teeth whose volume is changed in accordance with driven-rotation of the inner rotor; an adjustment ring which is relatively rotatably fitted on the outer rotor and configured to allow a rotation center of the outer rotor to revolve about a rotation center of the inner rotor, wherein the adjustment ring is provided with an operation portion to which a driving force is input; and the oil pump includes a guide means which is formed in the adjustment ring and the casing and configured to guide the adjustment ring when the operation portion is operated.

With this configuration, by an operation on the operation portion of the adjustment ring, the guide means allows the slidably contacting portion of adjustment ring to always come into contact with the guide face of the casing, and the actuation in which the rotation center of the outer rotor is allowed to revolve about the rotation center of the inner rotor can be realized. With this configuration, the slidably contacting portion formed in the adjustment ring is always brought into contact with the guide face. Therefore, as compared with a structure in which the cam ring can freely moved as in Patent Document 1, an amount of engagement between the outer teeth of the inner rotor and the inner teeth of the outer rotor is not changed. In addition, the slidably contacting portion and the guide face have only to be formed in a size corresponding to a stroke necessary for the movement of the adjustment ring, and thus growth in size can be prevented. As a result, by changing the eccentric positional relationship between the inner rotor and the outer rotor, the oil pump whose discharge amount is adjustable with high accuracy can be made compact. Especially with this configuration, when the adjustment ring is moved in a revolution manner, a form of movement of the operation portion is not limited to one, and various forms of movement are applicable, unlike the above-described case. Therefore, it becomes possible to freely determine an operation stroke, an operation direction or the like of the operation portion, leading to an effect of enhancing freedom in designing.

In the present invention, the guide means may include a guide pin which is provided on one of the adjustment ring and the casing; and a guide groove which is provided on the other of the adjustment ring and the casing and configured to guide the guide pin. In addition, the guide means may include a protrusion which is provided on one of the adjustment ring and the casing and extends in a direction toward the other of the adjustment ring and the casing; and a guide groove which is provided on the other of the adjustment ring and the casing and configured to guide the protrusion.

With this configuration, the adjustment ring can be actuated while guided by the guide means formed of the guide pin and the guide groove. In addition, the adjustment ring can be actuated while guided by the guide means formed of the protrusion and the guide groove.

In the present invention, an actuation trajectory of the adjustment ring may coincide with a shape of the guide groove in a circumferential direction and a radial direction of the inner rotor.

With this configuration, the adjustment ring can be actuated along the actuation trajectory corresponding to the shape of the guide groove.

In the present invention, the guide means may include a guide pin which is provided on one of the adjustment ring and the casing and arranged in parallel with the drive-rotation axis; and a guide groove which is provided on the other of the adjustment ring and the casing, formed along an actuation trajectory of the adjustment ring at a position opposing the guide pin, and configured to guide the guide pin. In addition, the guide means may include a protrusion which is provided on one of the adjustment ring and the casing and protrudes in a direction perpendicular to the drive-rotation axis; and a guide groove which is provided on the other of the adjustment ring and the casing, formed along an actuation trajectory of the adjustment ring at a position opposing the protrusion, and configured to guide the protrusion.

With this configuration, by guiding the guide pin along the guide groove, or by guiding the protrusion along the guide groove, the adjustment ring can be actuated along the actuation trajectory.

In the present invention, the guide groove may be formed of at least one of: a rotation guide groove portion configured to guide the adjustment ring along a trajectory having a turning center which coincides with the rotation center of the outer rotor; and a revolution guide groove portion configured to guide the adjustment ring along a trajectory of revolution about the rotation center of the inner rotor. In addition, the guide groove may be formed of at least one of: a rotation guide groove portion configured to guide the adjustment ring along a trajectory having a turning center which coincides with the rotation center of the outer rotor; and a revolution guide groove portion configured to guide the adjustment ring along a turning trajectory which coincides with a turning trajectory of the rotation center of the outer rotor about the axis of the inner rotor as a turning center.

With this configuration, by the rotation guide groove portion, the adjustment ring can be allowed to rotate about the rotation center of the outer rotor. In addition, by the revolution guide groove portion, the adjustment ring can be allowed to revolve about the rotation center of the inner rotor, or the adjustment ring can be allowed to revolve along the trajectory obtained by turning of the rotation center of the outer rotor about the center of the inner rotor as a turning center.

In the present invention, when the adjustment ring is guided along the rotation guide groove portion, a fluid pressure of the fluid discharged from the discharge outlet may become proportional to a rotational speed of the inner rotor and the outer rotor, and when the adjustment ring is guided along the revolution guide groove portion, the fluid pressure of the fluid discharged from the discharge outlet may become proportional to the rotational speed of the inner rotor and the outer rotor, while being reduced.

With this configuration, for example, when the adjustment ring is guided along the guide groove which is a combination of the rotation guide groove portion and the revolution guide groove, a state can be achieved in which a fluid having a reduced pressure is discharged, while a fluid having a fluid pressure proportional to a rotational speed of driven rotation is discharged.

In the present invention, when the adjustment ring is guided along the rotation guide groove portion, an eccentric direction of the inner rotor and the outer rotor may not be changed, and when the adjustment ring is guided along the revolution guide groove portion, the eccentric direction of the inner rotor and the outer rotor may be changed.

With this configuration, when the outer rotor is guided along the rotation guide groove and is rotated, the engagement position between the outer teeth of the inner rotor and the inner teeth of the outer rotor is not changed, and the discharge amount of the fluid is not changed. When the outer rotor is guided along the revolution guide groove and is revolved, the engagement position between the outer teeth of the inner rotor and the inner teeth of the outer rotor is changed and the discharge amount of the fluid is changed.

In the present invention, the operation portion may include a first operation portion to which the fluid is supplied and a second operation portion to which the fluid is supplied, and is provided with a blocking portion configured to prevent a flow of the fluid between the first operation portion and the second operation portion. In addition, the oil pump may further include a control valve configured to control a supply of the fluid to the first operation portion.

With this configuration, the actuation of the adjustment ring can be realized in which the fluid is selectively supplied to one of the first operation portion and the second operation portion. In addition, the actuation of the adjustment ring can be controlled by controlling the fluid to the first operation portion, using the control valve.

In present invention, all of a plurality of the spaces between the outer teeth of the inner rotor and the inner teeth of the outer rotor may be allowed to communicate with the suction inlet or the discharge outlet. In addition, a shape of the outer teeth of the inner rotor and a shape of the inner teeth of the outer rotor may be configured to allow all of a plurality of the spaces between the outer teeth and the inner teeth to communicate with the suction inlet or the discharge outlet.

With this configuration, a fluid in the space between the outer teeth and the inner teeth can be sent out to the discharge outlet through the communication. In addition, the fluid in the space between the outer teeth and the inner teeth is sent out to the discharge outlet by utilizing the shapes of the outer teeth and the inner teeth, and thus the inner rotor and the outer rotor can be smoothly rotated.

In the present invention, the casing may be provided with a communicating groove configured to allow a plurality of the spaces between the outer teeth and the inner teeth to communicate with the suction inlet or the discharge outlet.

With this configuration, the fluid in the space between the outer teeth and the inner teeth is sent out to the suction inlet or discharge outlet by utilizing the communicating groove, and therefore the inner rotor and the outer rotor can be smoothly rotated.

In the present invention, the communicating groove may include: a first communicating groove configured to allow the space to communicate with a pocket portion between the outer rotor and the adjustment ring; and a second communicating groove configured to allow the pocket portion to communicate with the suction inlet.

With this configuration, the fluid in the space between the outer teeth and the inner teeth can be sent to the pocket portion of the adjustment ring outward of the outer rotor, and vice versa, by utilizing the first communicating groove. In addition, the fluid in the pocket portion can be sent to the suction inlet, by utilizing the second communicating groove. Accordingly, the inner rotor and the outer rotor can be smoothly rotated.

In the present invention, the guide means may be configured to allow a slidably contacting portion of the adjustment ring to slide over a guide face of the casing all the time, during an operation of the operation portion.

With this configuration, when the operation portion is operated, the slidably contacting portion of the adjustment ring is always brought into contact with the guide face of the casing, and the adjustment ring is guided so as to reflect the shape of the guide face.

In the present invention, the slidably contacting portion may be formed of two protrusions provided on the adjustment ring, the guide faces may be provided in the casing so as to come into slidable contact with the respective two protrusions, and the casing may be provided with pressing means configured to press the adjustment ring so that a center of the adjustment ring is directed in a direction towards a position between the two protrusions.

With this configuration, by the use of the two protrusions, the respective guide faces, and the pressing means, the posture of the adjustment ring is determined. Therefore, regardless of the operation amount of the adjustment ring, the adjustment ring can be retained at a desired position, and stable adjustment of the discharge amount can be realized.

In present invention, the operation portion may be provided with an arm portion formed in a portion of the adjustment ring, a fluid reservoir may be formed in a space on one side of the arm portion which space is enclosed by an inner wall of the casing and an outer wall of the adjustment ring, a biasing member configured to press the arm portion may be provided on the other side of the arm portion, and the arm portion may be configured to be driven based on a fluid pressure of the fluid reservoir and a biasing force of the biasing member.

With this configuration, by adjusting a fluid pressure acting on the arm portion, the operation amount of the arm portion can be appropriately changed and the discharge amount of the fluid can be appropriately adjusted.

In the present invention, the pump may include: the inner rotor having (n) of the outer teeth where (n) is a natural number; and the outer rotor having (n+1) of the inner teeth configured to engage with the outer teeth, the rotors of the oil pump may be configured to transport the fluid by suction and discharge of the fluid caused by a volumetric change of a cell formed between tooth plane surfaces of the rotors when the rotors are engaged with each other and rotated, and a shape of the outer teeth of the inner rotor may be obtained by the following equations, with respect to a teeth profile formed by a mathematical curve having an addendum circle A1 with a radius RA1 and a root circle A2 with a radius of RA2:

$$RA1>RD1>RA2 \quad \text{Equation (1)}$$

$$RA1>RD2>RA2 \quad \text{Equation (2)}$$

$$RD1\geq RD2 \quad \text{Equation (3).}$$

With this configuration, by deforming a portion of the teeth profile outward of a circle having a radius satisfying Equation (1) to outside in a radial direction, or deforming a portion of the teeth profile inward of a circle having a radius satisfying Equations (2) and (3) to inside in the radial direction, or by the combination of these deformations, the discharge amount of the oil pump can be increased without reducing the teeth number.

DESCRIPTION OF EMBODIMENTS

<Embodiment 1>

Hereinbelow, an embodiment of the present invention will be described below with reference to the drawings.

<Basic Configuration>

Figure 1:
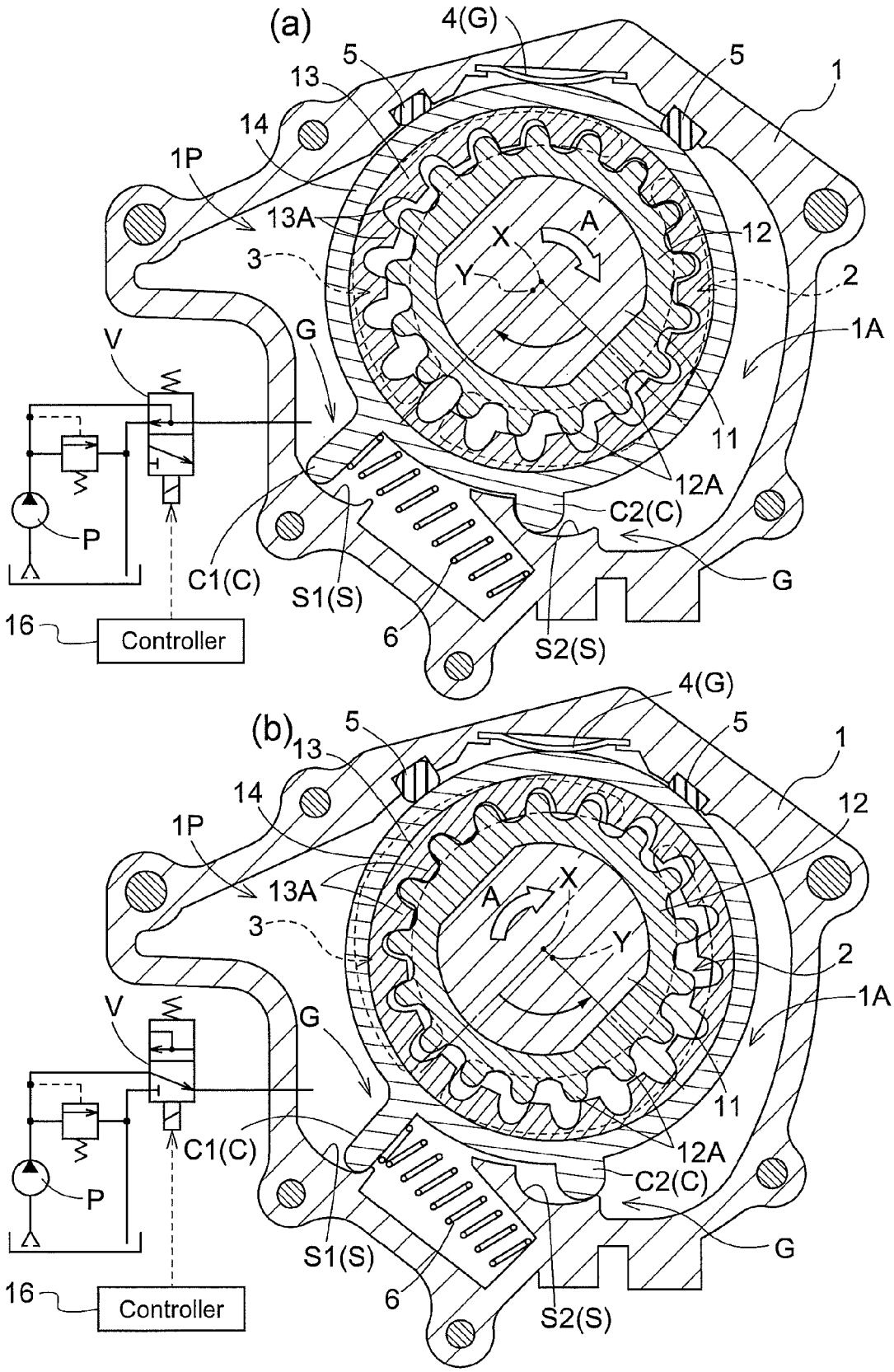
FIGS. 1(*a*) and 1(*b*) show cross-sectional views of an oil pump according to Embodiment 1, FIG. 1(*a*) in a state in which an adjustment ring is at an initial position and FIG. 1(*b*) in a state in which the adjustment ring is moved to the limit.

FIG. 1 shows an oil pump provided in a vehicle with an engine, such as automobile. The oil pump includes a drive shaft 11 arranged coaxially with a drive-rotation axis X inside a casing 1. The oil pump further includes: an inner rotor 12 configured to rotate with the drive shaft 11 in a unified manner; inner teeth 13A configured to engage with outer teeth 12A of the inner rotor 12; and an outer rotor 13 supported rotatably about a driven axis Y (rotation center) which is eccentric to the drive-rotation axis X.

This oil pump includes a suction inlet 2 and a discharge outlet 3 provided in a wall 1A of the casing 1 configured to suck and discharge oil as fluid in accordance with a space between the outer teeth 12A and the inner teeth 13A. The oil pump further includes: an adjustment ring 14 fitted on the outer rotor 13; and a guide means G configured to set a posture of the adjustment ring 14 by bringing a slidably contacting portion C of the adjustment ring 14 into slidable contact with a guide face S of the casing.

Though not shown, in the casing 1, a wall is provided at a position opposing the wall 1A, in parallel with the wall 1A. The inner rotor 12, the outer rotor 13 and the adjustment ring 14 are disposed between a pair of the walls of the casing 1. In addition, the drive shaft 11 penetrates at least one of a pair of the walls.

This oil pump is used for supplying lubricating oil to the engine and operating oil to a hydraulic actuator of the automobile or the like. The drive shaft 11 is configured to be rotary-driven by a driving force from an output shaft of the engine. In addition, this oil pump has a configuration for adjusting the discharge amount of oil, which will be described below.

The outer teeth 12A of the inner rotor 12 have a tooth plane profile in a shape of a trochoid curve or a cycloid curve. In an inner periphery of the outer rotor 13, the inner teeth 13A are formed which have one more tooth than the number of the outer teeth 12A of the inner rotor 12. The inner teeth 13A of the outer rotor 13 are configured to have a tooth plane profile which allows the inner teeth 13A to come into contact with the outer teeth 12A of the inner rotor 12, when the inner rotor 12 is rotated about the drive-rotation axis X, and at the same time, in conjunction with this rotation, the outer rotor 13 is rotated about the driven axis Y.

In this oil pump, the inner rotor 12 is driven-rotated in a direction of an arrow A. Therefore, when the adjustment ring 14 is at a posture shown in FIG. 1(*a*) (initial position), the suction inlet 2 faces a negative pressure acting region which reduces a pressure of oil between the outer teeth 12A of the inner rotor 12 and the inner teeth 13A of the outer rotor 13, and the discharge outlet 3 faces a positive pressure acting region which compresses oil between the outer teeth 12A of the inner rotor 12 and the inner teeth 13A of the outer rotor 13. Accordingly, the oil pump functions to suck oil from the suction inlet 2 and to discharge oil from the discharge outlet 3.

An outer periphery of the outer rotor 13 has a circular shape with the driven axis Y as a center, and an inner periphery of the adjustment ring 14 has a circular shape having an inner diameter that allows the outer rotor 13 to fit thereinto. The outer rotor 13 is rotatably supported on the inner periphery of the adjustment ring 14. With this configuration, a center of the inner periphery of the adjustment ring 14 coincides with a position of the driven axis Y of the outer rotor 13.

In an outer periphery of the adjustment ring 14, as the slidably contacting portion C (also functions as protrusion), a first arm portion C1 and a second arm portion C2, each extending in a direction away from the driven axis Y, are formed. In addition, as the guide face S, a smooth first guide face S1 and a smooth second guide face S2, which are brought into slidable contact with a terminal of the first arm portion C1 and a terminal of the second arm portion C2, respectively, are integrally formed in the casing 1.

In this oil pump, in a case where the adjustment ring 14 is moved from a posture shown in FIG. 1(*a*) to a posture shown in FIG. 1(*b*) while retaining a state in which the terminal of the first arm portion C1 and the terminal of the second arm portion C2 are brought into contact with the first guide face S1 and the second guide face S2, respectively, an engagement relationship between the outer teeth 12A of the inner rotor 12 and the inner teeth 13A of the outer rotor 13 reaches a positional relationship in which the driven axis Y is revolved 90 degrees.

The shapes of the first guide face S1 and the second guide face S2 are configured to have envelope curves obtained based on the position of the terminal of the first arm portion C1 and the position of the terminal of the second arm portion C2, respectively, when a position of the driven axis Y is revolved about the drive-rotation axis X (moved along a revolution orbit). It should be noted that, the operation of the adjustment ring 14 is accompanied with a rotational movement and a translational movement on the curve, and a combination of these movement is arbitrarily selected. Therefore, the motion of the adjustment ring 14 can be defined by appropriately setting an actuation amount of the first arm portion C1, as long as the driven axis Y is revolved about the drive-rotation axis X.

In the present embodiment, in order to bring the first arm portion C1 and the second arm portion C2 into slidable contact with the first guide face S1 and the second guide face S2, respectively, an inner face of the casing is provided with a plate spring 4 configured to press the adjustment ring 14 in a direction towards a position between the first arm portion C1 and the second arm portion C2. The plate spring 4 has a function as pressing means configured to bring the first arm portion C1 and the second arm portion C2 as the slidably contacting portion C into slidable contact with the first guide face S1 and the second guide face S2, respectively.

The guide means G of the present invention is formed of the first arm portion C1 and the second arm portion C2 as the slidably contacting portion C, the first guide face S1 and the second guide face S2, and the plate spring 4. In addition, two sealing members 5 made of flexible material that can be flexibly deformable are provided at two positions in the outer periphery of the adjustment ring 14 flanking the plate spring 4.

The first arm portion C1 functions as an operation portion of the present invention. A fluid reservoir 1P is formed in a space on one side of the first arm portion C1 in terms of a moving direction thereof, which space is enclosed by an inner wall of the casing and an outer wall of the adjustment ring 14. In addition, a compression coil spring 6 as a biasing member is provided on the other side of the first arm portion C1 in terms of the moving direction thereof.

This oil pump includes a solenoid valve V configured to control a control oil from a hydraulic pump P. In addition, in order to control the solenoid valve V, the oil pump further includes a controller 16. The controller 16 is configured to obtain information such as engine rotational speed, engine load, and water temperature, and control the solenoid valve V based on the obtained information.

By performing such a control, the control oil is supplied to and discharged from the fluid reservoir 1P by the solenoid valve V, to thereby adjust the discharge amount of oil by the oil pump. As a result, pressure loss or the like under low oil temperature can be compensated.

It should be noted that, in the present embodiment, the adjustment ring 14 is configured to be freely switchable between the position shown in FIG. 1(*a*) and the position shown in FIG. 1(*b*) by the control of the solenoid valve V. Alternatively, for example, the control may be designed in such a manner that the posture of the adjustment ring 14 is set to a target posture, by providing a sensor, such as potentiometer, configured to feed back the posture of the adjustment ring 14. By configuring a control system as described above, it becomes possible to non-stepwise adjust the discharge amount of oil.

Moreover, in this oil pump, oil can be discharged from the discharge outlet 3 with a fluid pressure directly proportional to the rotational speed of the inner rotor 12 and the outer rotor 13.

<Form of actuation>

Like in the case where a pressure of the control oil acting on the fluid reservoir 1P is set to zero by the solenoid valve V, when the pressure of the control oil acting on the fluid reservoir 1P is smaller than a pressure by the compression coil spring 6, the adjustment ring 14 is retained at the position shown in FIG. 1(*a*) by a biasing force of the compression coil spring 6 and a biasing force of the plate spring 4. At this position, oil is sucked from the suction inlet 2 and the oil is discharged from the discharge outlet 3 by driven-rotation of the drive shaft 11, as described above.

On the other hand, like in the case where the operating oil is supplied to the fluid reservoir 1P by the solenoid valve V, when the pressure of the control oil acting on the fluid reservoir 1P becomes larger than the biasing force of the compression coil spring 6, the first arm portion C1 and the second arm portion C2 are moved along the first guide face S1 and the second guide face S2, respectively, and the adjustment ring 14 is moved to the posture shown in FIG. 1(*b*).

In this movement of the adjustment ring 14, the driven axis Y is allowed to revolve about the drive-rotation axis X, and at the same time, the adjustment ring 14 is allowed to rotate about the driven axis Y. Accordingly, during this movement, the outer rotor 13 is also moved, and the driven axis Y is allowed to revolve about the drive-rotation axis X, while the outer teeth 12A of the inner rotor 12 and the inner teeth 13A of the outer rotor 13 are engaged with each other.

As described above, the positive pressure acting region and the negative pressure acting region are moved about the drive-rotation axis X, a negative pressure in the negative pressure acting region which acts on the suction inlet 2 is reduced, and a positive pressure in the positive pressure acting region which acts on the discharge outlet 3 is also reduced. As a result, the amount of oil supplied by this oil pump is reduced.

When the adjustment ring 14 is moved to the position shown in FIG. 1(*b*), the negative pressure acting region and the positive pressure acting region reach a positional relationship in which they bridge the suction inlet 2 and the discharge outlet 3. Therefore, a negative pressure hardly acts on the suction inlet 2, a positive pressure hardly acts on the discharge outlet 3, and oil is not supplied nor discharged. As a consequence, the discharge amount of oil can be reduced.

As described above, the oil pump of the present invention has the guide means G configured to allow the adjustment ring 14 to revolve 90 degrees about the driven axis Y, while arbitrarily combining a rotational movement and a translational movement on the curve. With this configuration, for example, the adjustment ring 14 alone can be actuated while arbitrarily setting a stroke of the first arm portion C1 provided on the adjustment ring 14, and thus nonstop adjustment of the discharge amount of oil can be performed. In this manner, the oil pump can be freely designed.

In order to move the driven axis Y, the first arm portion C1 and the second arm portion C2 forming the slidably contacting portion C are provided, and corresponding to these, the first guide face S1 and the second guide face S2 are provided. With this simple configuration, the adjustment ring 14 can be moved with high accuracy, and an amount of engagement between the outer teeth 12A of the inner rotor and the inner teeth 13A of the outer rotor 13 can be appropriately retained.

Especially, in order to move the adjustment ring 14, the biasing force of the compression coil spring 6 is allowed to act on the first arm portion C1, and the solenoid valve V is provided which is configured to control the pressure of the control oil. Although this is a relatively simple configuration, the discharge amount of oil can be made appropriate based on the rotational speed of the engine and the engine load. Especially, the outer rotor 13 can be moved to a desired position by using an electronic control. With this configuration, the discharge amount of oil can be adjusted with high accuracy and energy loss is further suppressed.

<Other Versions of Embodiment 1>

Instead of the above-described Embodiment 1, the present invention may be configured in the following manner (in the embodiment which will be describe below, the components having the same function as those in Embodiment 1 are designated with the same referential characters as in Embodiment 1).

Figure 2:
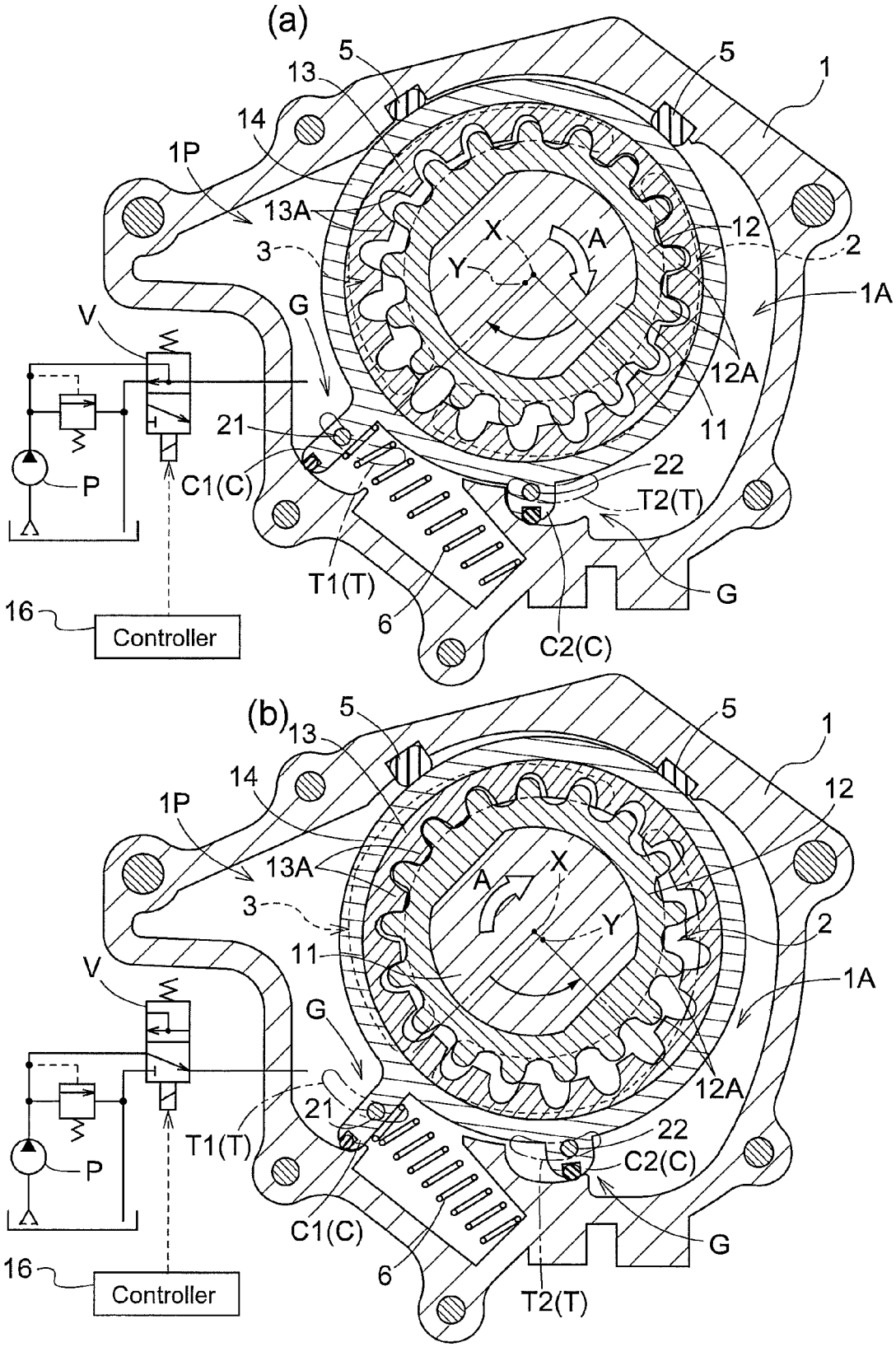
FIGS. 2(*a*) and 2(*b*) show cross-sectional views of the oil pump according to another version of Embodiment 1, FIG. 2(*a*) in a state in which the adjustment ring is at an initial position and FIG. 2(*b*) in a state in which the adjustment ring is moved to the limit.

(a) As shown in FIG. 2, the guide means G includes: a first guide pin 21 and a second guide pin 22 which penetrate through the first arm portion C1 and the second arm portion C2 formed in the adjustment ring 14, respectively, in a direction parallel to the drive-rotation axis X; and an arc-shaped first guide groove T1 and an arc-shaped second guide groove T2 formed in the wall 1A of the casing 1 so as to correspond to the first guide pin 21 and the second guide pin 22, respectively.

The shapes of the first guide groove T1 and the second guide groove T2 are configured in such a manner that, when the adjustment ring 14 is moved, the driven axis Y is allowed to revolve about the drive-rotation axis X, and at the same time, the adjustment ring 14 is allowed to rotate about the driven axis Y. It should be noted that, in this version, in the case of the pump in which the adjustment ring 14 is actuated by supplying the control oil to the fluid reservoir 1P, a sealing member or the like is provided which can prevent a leakage of the control oil from the portions of the first guide groove T1 and the second guide groove T2.

With this configuration, the plate spring 4 used in the embodiment described above can be omitted, and the structure becomes more simplified. In addition, with this configuration, between the terminal of the first arm portion C1 and the casing 1, and between the terminal of the second arm portion C2 and the casing 1, there is no need to form a guide face, and thus the configuration does not require any more than an oil sealing member.

(b) In an opposite manner to the configuration of the version (a), the guide means G is formed of: the first guide pin 21 and the second guide pin 22 projecting from the wall 1A of the casing 1; and arc-shaped guide holes formed in the first arm portion C1 and the second arm portion C2, with which the first guide pin 21 and the second guide pin 22 are engageably inserted, respectively.

The shape of the guide hole is configured in such a manner that, when the adjustment ring 14 is moved, the driven axis Y is allowed to revolve about the drive-rotation axis X, and at the same time, the adjustment ring 14 is allowed to rotate about the driven axis Y. As a result, the plate spring 4 used in the embodiment described above can be omitted, and the structure becomes more simplified.

(c) The oil from the pump driven by the engine is supplied to the fluid reservoir 1P as the control oil. By supplying the control oil whose pressure increases in conjunction with the rotational speed of the engine, the discharge amount of oil from the oil pump of the present invention can be controlled in accordance with the rotational speed of the engine.

(d) An electric motor is provided as an operation portion for actuating the adjustment ring. By providing such an electric motor, the discharge amount of oil by the oil pump can be adjusted at a desired timing, when needed.

<Embodiment 2>

Figure 3:
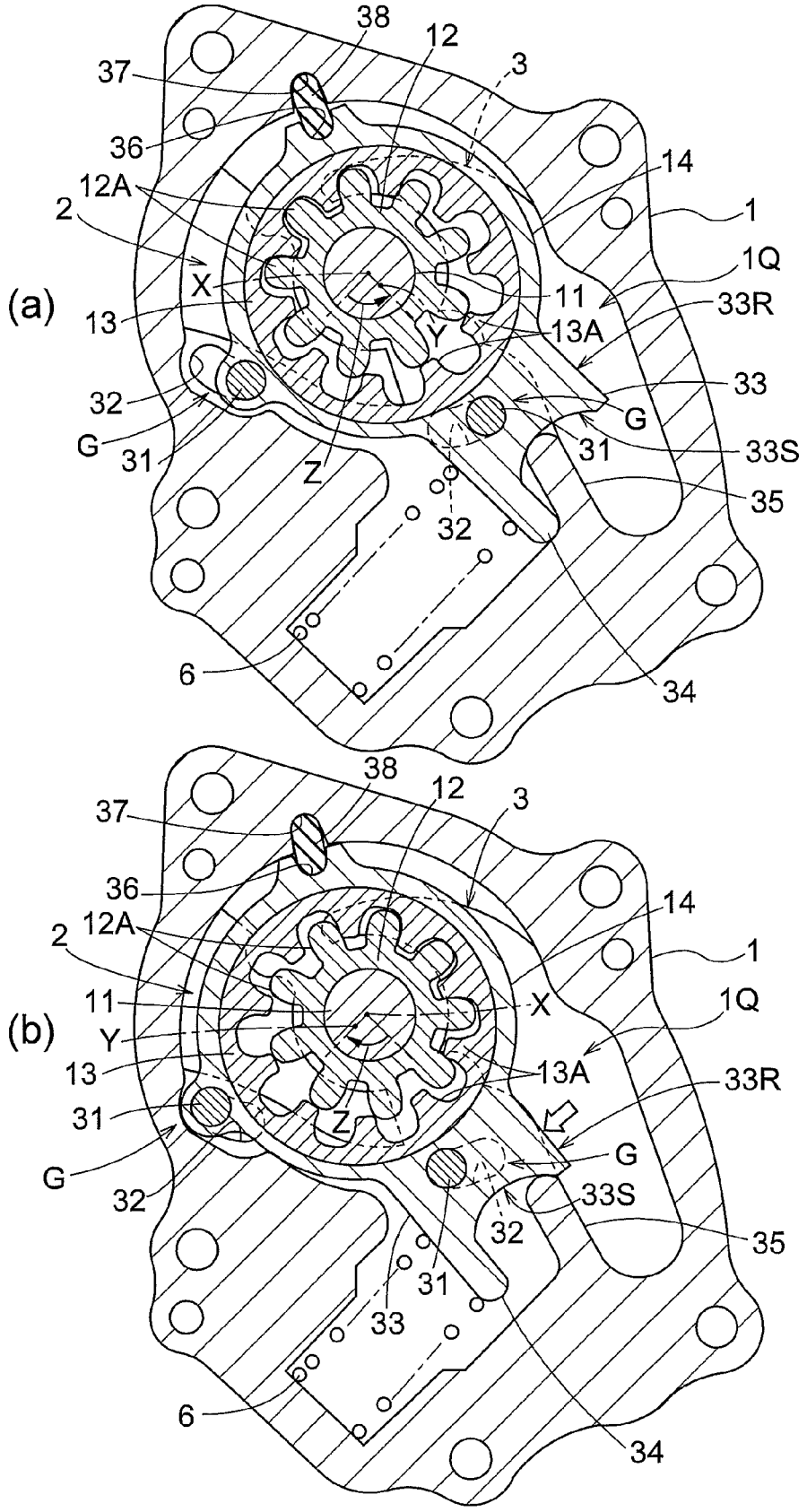
FIGS. 3(*a*) and 3(*b*) show cross-sectional views of the oil pump according to Embodiment 2, FIG. 3(*a*) in a state in which the adjustment ring is at an initial position and FIG. 3(*b*) in a state in which the adjustment ring is moved to the limit.

As shown in FIG. 3, the oil pump of Embodiment 2 is the same as the oil pump of Embodiment 1, in the configurations of the casing 1, the drive shaft 11, the inner rotor 12, and the outer rotor 13. Especially in Embodiment 2, the configuration for adjusting the discharge amount of the fluid by the actuation of the adjustment ring 14 rotatably fitted onto the outer rotor 13 is different. It should be noted that the components which are the same as those described in Embodiment 1 are designated with the same referential characters as in Embodiment 1.

In this oil pump, like in the above-described Embodiment 1, the inner rotor 12 and the outer rotor 13 are disposed between two casings 1. In the wall of the casing 1, there are formed the suction inlet 2 and the discharge outlet 3. Inside the casing 1, a pressurization space 1Q is formed which is configured to allow a discharge pressure from the discharge outlet 3 to act on a block portion 33.

In each of two portions of the adjustment ring 14, a guide pin 31 is formed which projects in parallel with the drive-rotation axis X. The wall of the casing 1 is provided with guide grooves 32 into which respective protruding ends of the guide pins 31 are fitted. The guide means G is formed of these two guide pins 31 and two guide grooves 32. The function of the guide groove 32 will be described later.

In the outer periphery of the adjustment ring 14, the block portion 33 and an operation arm 34 (one example of operation portion) both protruding in a radial direction of the adjustment ring 14 are integrally formed. In a portion of the block portion 33 on an outer end side in the radial direction of the adjustment ring 14, a slidably contacting face 33S is formed, and in a portion of the adjustment ring 14 facing the pressurization space 1Q, a pressure receiving face 33R is formed.

A partition wall 35 configured to come into slidable contact with the slidably contacting face 33S is formed in the casing 1, that protrudes inward of the casing 1, and the compression coil spring 6 configured to act the biasing force on the operation arm 34 is contained in a space for the operation arm 34 inside the casing 1. The shape of the slidably contacting face 33S is configured in such a manner that a terminal of the partition wall 35 is retained to come into contact therewith, when the adjustment ring 14 is actuated while guided by the guide means G In addition, an engagement recess 36 is formed on a side opposite to the block portion 33 in the outer periphery of the adjustment ring 14. A support recess 37 is formed in the casing 1 at a position facing the engagement recess 36. Between the engagement recess 36 and the support recess 37, a sealing vane 38 is disposed. Due to the presence of the sealing vane 38, and a slidably contacting structure between the slidably contacting face 33S and the partition wall 35, pressure reduction in the pressurization space 1Q can be suppressed.

The shapes of the two guide grooves 32 are configured in such a manner that a rotation guide groove portion 32A for allowing the outer rotor 13 to rotate about the driven axis Y and a revolution guide groove portion 32B for allowing the outer rotor 13 to revolve about the drive-rotation axis X are combined.

Figure 4:
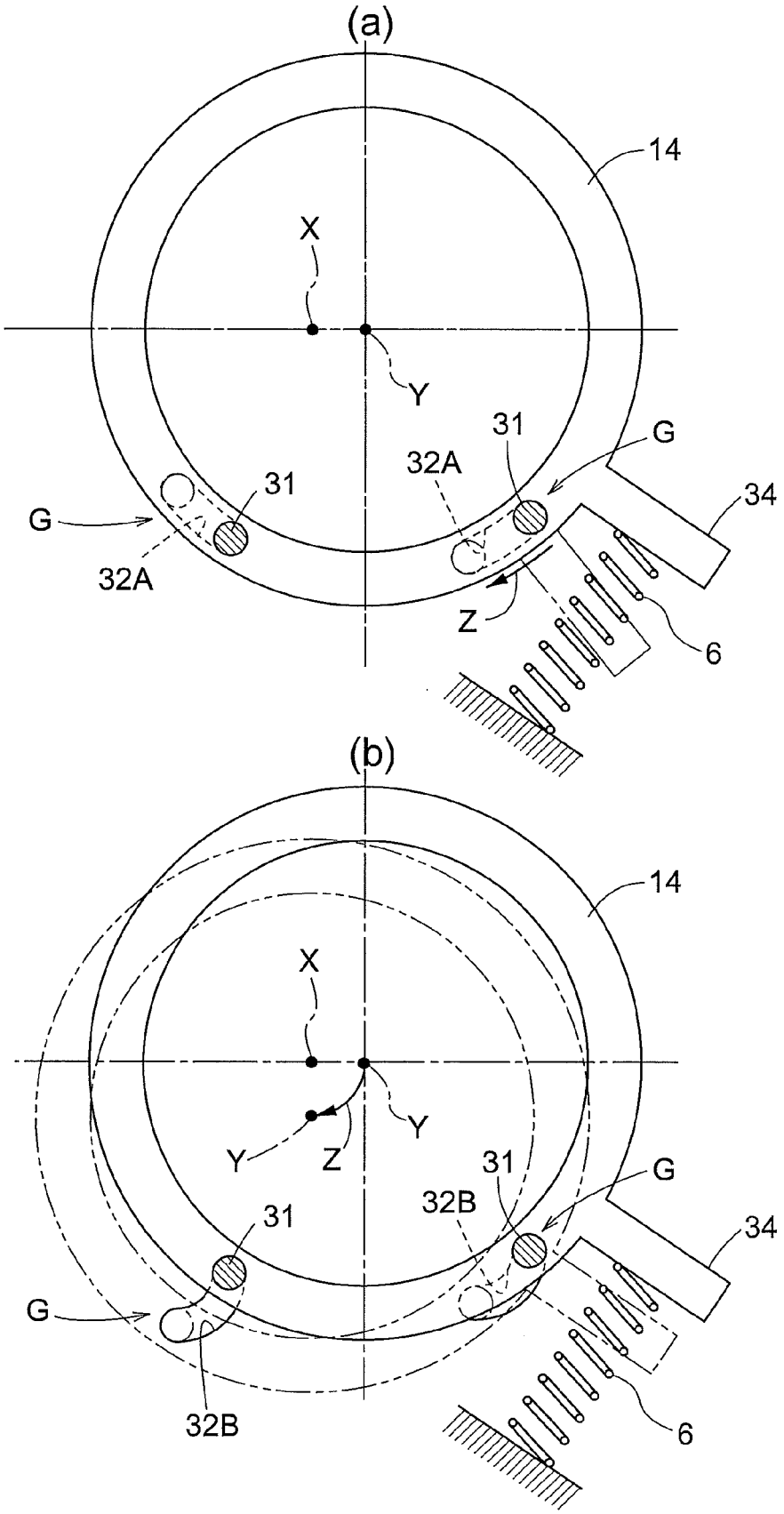
FIGS. 4(*a*) and 4(*b*) show diagrams of shapes and forms of actuation of a rotation guide groove portion and a revolution guide groove portion, respectively, in Embodiment 2.

A principle of the rotation using the rotation guide groove portion 32A will be described below. As shown in FIG. 4(*a*), each rotation guide groove portion 32A is configured to have an arch shape with the driven axis Y as a center. Therefore, when the adjustment ring 14 is actuated with the guide pin 31 being guided by the rotation guide groove portion 32A, the position of the driven axis Y of the outer rotor 13 is not changed. In other words, an eccentric direction between the inner rotor 12 and the outer rotor 13 (relative eccentric positional relationship) is not changed.

From the reasons described above, when the adjustment ring 14 is actuated along the rotation guide groove portion 32A, the engagement position between the outer teeth 12A of the inner rotor 12 and the inner teeth 13A of the outer rotor 13 is not changed, and the discharge performance of the oil pump is not changed. It should be noted that the discharge performance of the oil pump is expressed as the discharge amount of oil relative to the rotational speed of the inner rotor 12 per unit time.

Next, a principle of the revolution using the revolution guide groove portion 32B will be described below. As shown in FIG. 4(*b*), each revolution guide groove portion 32B is configured to have the same shape in a circumferential direction and a radial direction as an actuation trajectory Z, which is obtained when the driven axis Y is revolved about the drive-rotation axis X. Therefore, when the adjustment ring 14 is actuated while the guide pin 31 is guided along the revolution guide groove portion 32B, both the adjustment ring 14 and the outer rotor 13 are revolved about the drive-rotation axis X along the actuation trajectory Z. In other words, an eccentric direction between the inner rotor 12 and the outer rotor 13 (relative eccentric positional relationship) is changed.

From the reasons described above, when the adjustment ring 14 is actuated along the revolution guide groove portion 32B, the engagement position between the outer teeth 12A of the inner rotor 12 and the inner teeth 13A of the outer rotor 13 is changed, and the discharge performance of the oil pump is changed.

Figure 5:
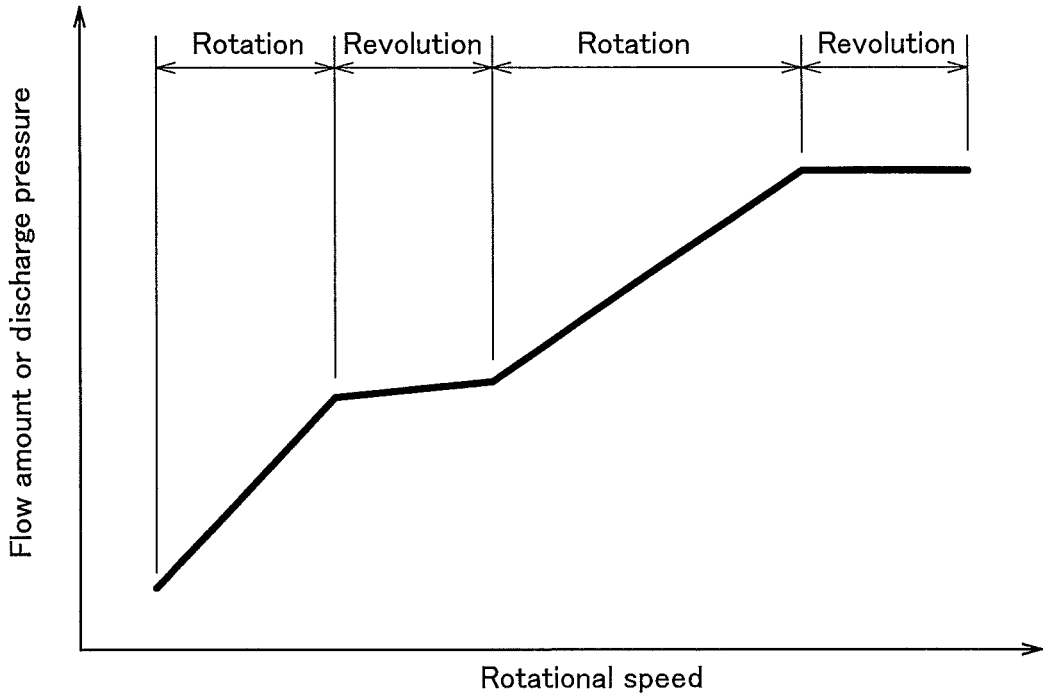
FIG. 5 is a graph showing discharge amount or discharge pressure of oil when the adjustment ring is rotated and revolved in Embodiment 2.

Especially, it is possible to set the change characteristics of the discharge amount or discharge pressure of oil to those as shown in FIG. 5, with respect to the case where the rotations and revolutions of the outer rotor 13 are performed when the rotational speed of the drive shaft 11 is changed. It should be noted that, the mechanism alternately performing the rotation and the revolution as in FIG. 5 has a different shape from that of the guide groove 32 in Embodiment 2.

Referring to the same drawing, in the circumstance where the outer rotor 13 is rotated, the discharge amount or discharge pressure of oil is changed in direct proportion to the rotational speed of the inner rotor 12. Next, in the circumstance where the outer rotor is revolved, regardless of the changes in the rotational speed of the inner rotor 12, the discharge amount or discharge pressure of oil is not changed to a large extent. Especially, in the oil pump of Embodiment 2, as the pressure of the pressurization space 1Q increases, the adjustment ring 14 is actuated from a posture shown in FIG. 3(*a*) (initial position) to a posture shown in FIG. 3(*b*). During this actuation, a protruding end of the partition wall 35 is retained to come into contact with the slidably contacting face 33S and thus oil leakage never occurs, leading to prevention of the pressure loss in the pressurization space 1Q. In addition, an actuation direction of the adjustment ring 14 is a direction which reduces the discharge amount of oil from the discharge outlet 3.

In other words, when the adjustment ring 14 is actuated while guided by the rotation guide groove portion 32A, oil in an amount directly proportional to the rotational speed of the inner rotor 12 and the outer rotor 13 is sent out from the discharge outlet 3. In addition, when the adjustment ring 14 is actuated while guided along the revolution guide groove portion 32B, oil in an amount directly proportional to the rotational speed of the inner rotor 12 and the outer rotor 13 is sent out from the discharge outlet 3, with the pressure of oil discharged from the discharge outlet 3 being reduced.

It should be noted that FIG. 5 illustrates a case where the rotation and the revolution are alternately performed. However, it is preferable to configure that, when the rotation is shifted to the revolution, the ratio of the revolution is gradually increased while the ratio of the rotation is gradually decreased, to thereby obtain a rotation trajectory of the adjustment ring 14 as a smooth curve. In other words, it is preferable to set a region in which the rotation and the revolution are performed at the same time, to obtain a gentle inflection point of the turning trajectory of the adjustment ring 14. As described above, by altering the ratio of the revolution and the ratio of the rotation, the adjustment ring 14 can be smoothly turned.

In this type of the oil pump, there happens a phenomenon that oil is trapped in a cell R which is an intermediate region in the outer teeth 12A of the inner rotor 12 and the inner teeth 13A of the outer rotor 13 between the suction inlet 2 and the discharge outlet 3 positioned on an opposite side of a region in which the outer teeth 12A and the inner teeth 13A are engaged most deeply.

Since the intermediate region is in a positional relationship in which this region communicates with neither the suction inlet 2 nor the discharge outlet 3, a load on the drive shaft 11 is increased at the moment the oil is trapped in the cell R in the intermediate region, which may lead to inconveniences, such as pulsation of the driving system and the oil pump, generation of abnormal noise, and inefficient fuel consumption.

In order to solve these inconveniences, minute gaps are formed between the outer teeth 12A of the inner rotor 12 and the inner teeth 13A of the outer rotor 13.

Specifically, the outer teeth profile of the inner rotor 12 is obtained in the following manner. Suppose there is a teeth profile formed by a mathematical curve having an addendum circle A1 with a radius RA1 and a root circle A2 with a radius of RA2. A portion of the teeth profile outward of a circle D1 having a radius RD1 satisfying the following Equation (1) is deformed to outside in the radial direction, or a portion of the teeth profile inward of a circle D2 having a radius RD2 satisfying the following Equations (2) and (3) is deformed to inside the radial direction:

$$RA1>RD1>RA2 \quad \text{Equation (1)}$$

$$RA1>RD2>RA2 \quad \text{Equation (2)}$$

$$RD1\geq RD2 \quad \text{Equation (3).}$$

Figure 6:
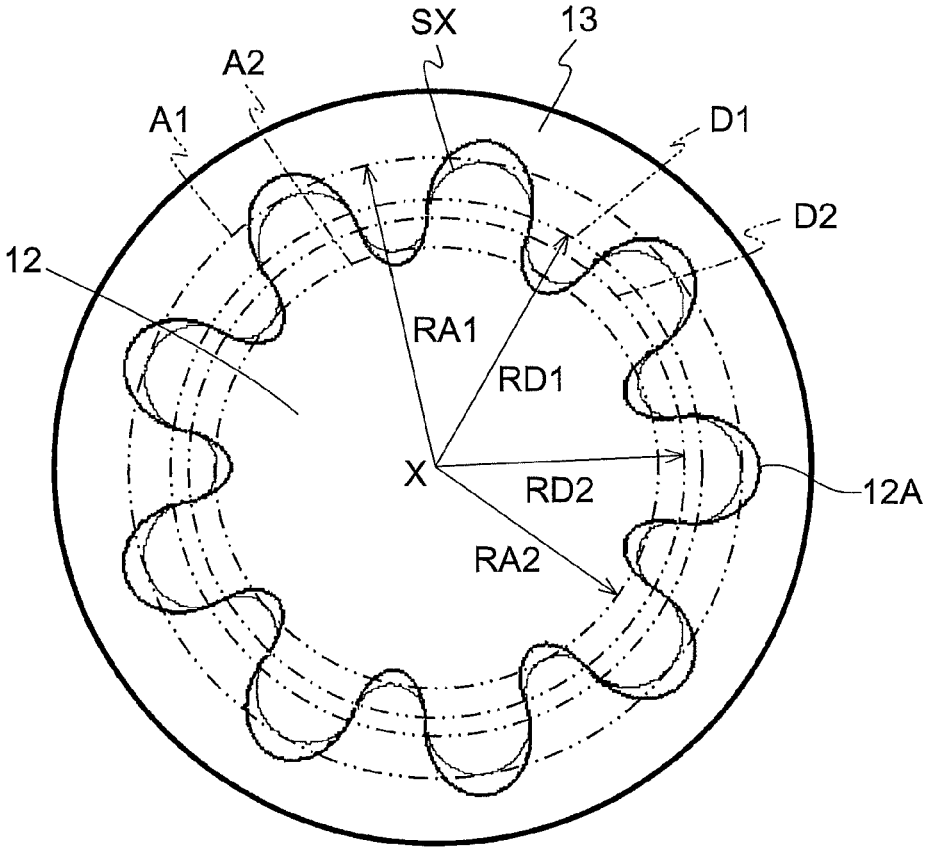
FIG. 6 is a schematic diagram showing forms of deformation upon setting the outer teeth profile of the inner rotor in Embodiment 2.

FIG. 6 shows profiles before and after a deformation of the teeth profile of the inner rotor 12. As a teeth profile SX formed of a known cycloid curve, one having the root circle A2 with the radius RA2 smaller than the radius RA1 of the addendum circle A1 is assumed. The teeth profile is obtained in the following manner: in a portion of the teeth profile SX outward of the circle D1 having the radius RD1 larger than the radius of the root circle A2, the teeth profile SX is deformed to outside in the radial direction, and in a portion of the teeth profile SX inward of the circle D2 having the radius RA2 which is smaller than the radius of the circle D1 and larger than the radius of the root circle A2, the teeth profile SX is deformed to inside in the radial direction.

By a cycloid curve corresponding to the teeth profile deformed as described above, the teeth profile of the inner rotor 12 is set, and further, based on the teeth profile of the inner rotor 12, the inner teeth 13A are formed which have one more tooth than the number of the outer teeth 12A of the inner rotor 12. The inner teeth 13A of the outer rotor 13 are set to have a tooth plane profile which allows the inner teeth 13A to come into contact with the teeth portion 12A of the inner rotor 12, when the outer rotor 13 is rotated about the driven axis Y, and in conjunction with this rotation, the inner rotor 12 is rotated about the drive-rotation axis X.

Figure 7:
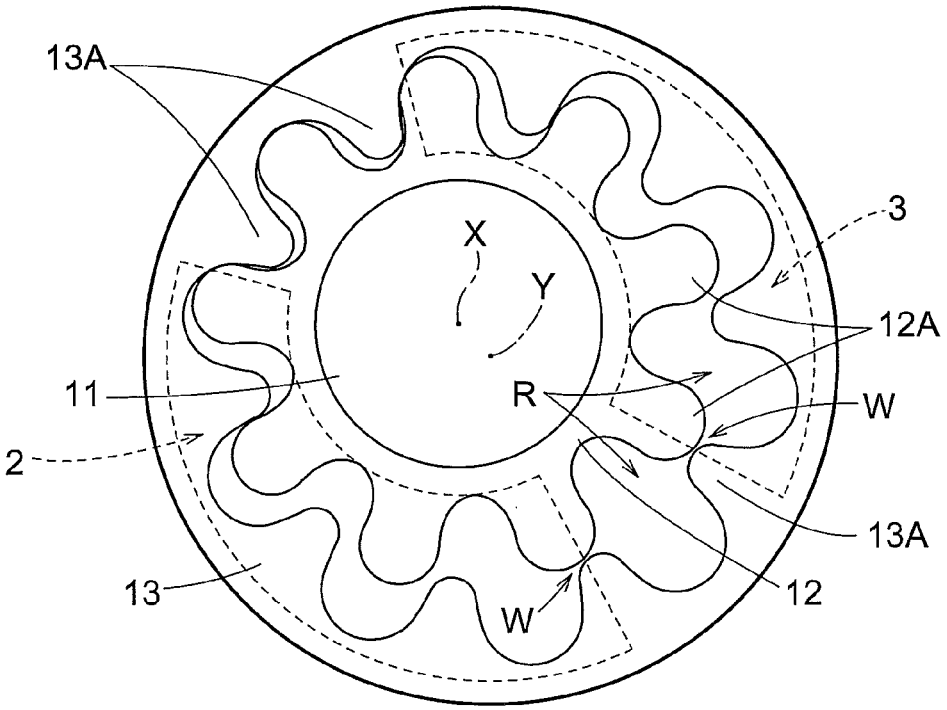
FIG. 7 is a diagram showing a gap formed between the outer teeth and the inner teeth in Embodiment 2.

By setting the teeth profile of the inner rotor 12 and the outer rotor 13 as described above, as shown in FIG. 7, even when the outer teeth 12A of the inner rotor 12 and the inner teeth 13A of the outer rotor 13 are in a positional relationship in which the oil is trapped in the cell R in the intermediate region, gaps W are formed between the outer teeth 12A and the inner teeth 13A, and the oil is sent out to the suction inlet 2 or the discharge outlet 3 through the gap W, to thereby solve the inconveniences, such as pulsation of the driving system and the oil pump, generation of abnormal noise, and inefficient fuel consumption.

As described above, the shape of the guide grooves 32 are configured in such a manner that the rotation region and the revolution region are combined. Therefore, as the rotational speed of the engine is increased, a pressure of the oil in the pressurization space 1Q is increased. In addition, when the pressure of the oil in the pressurization space 1Q is increased, a pressure acting on the pressure receiving face 33R of the block portion 33 is increased, and the adjustment ring 14 is actuated to a position where this pressure and the biasing force of the compression coil spring 6 are balanced.

During this actuation, since the posture of the adjustment ring 14 is determined by the guide means G, the outer rotor 13 is revolved while being rotated, and thus discharge performance of the oil pump is reduced. Though the rotational speed of the inner rotor 12 is increased along with the increase of the rotational speed of the engine, the discharge performance of the oil pump is reduced, and thus the discharge amount of oil does not become proportional to the increase in the rotational speed of the engine, and the discharge amount of oil is suppressed.

As described above, in Embodiment 2, by providing the two guide pins 31 and the respective two guide grooves 32, any form of actuation can be adopted, from among a form of actuation in which the outer rotor 13 is allowed to rotate, a form of actuation in which the outer rotor 13 is allowed to revolve, and a form of actuation in which these forms are combined. Accordingly, by the setting of the shape of the guide groove 32, even when the rotational speed of the engine is increased, the discharge amount or discharge pressure of oil can be set at the desired level. As a result, inconveniences can be prevented, such as discharge of an excessive amount of oil, and excessive increase in the discharge pressure, which leads to inefficient fuel consumption of the engine.

<Other Versions of Embodiment 2>

(a) In Embodiment 2, the guide means G is formed of the guide pin 31 and the guide groove 32. Alternatively, for example, the guide means G may be formed of: protrusions protruding from the outer periphery of the adjustment ring 14 in a direction orthogonal to the drive-rotation axis; and guide grooves formed in the casing 1 at positions opposing the respective protrusions. Specifically, this configuration is similar to that described in <Other versions of Embodiment 1>, but is different from Embodiment 1 in that the shapes of the two guide grooves are the same.

(b) In addition, as the guide means G, protrusions may be formed in the casing 1, and guide grooves with which the respective protrusions come into contact may be formed in the adjustment ring 14. In this version, the shapes of the two guide grooves are the same.

<Embodiment 3>

Figure 8:
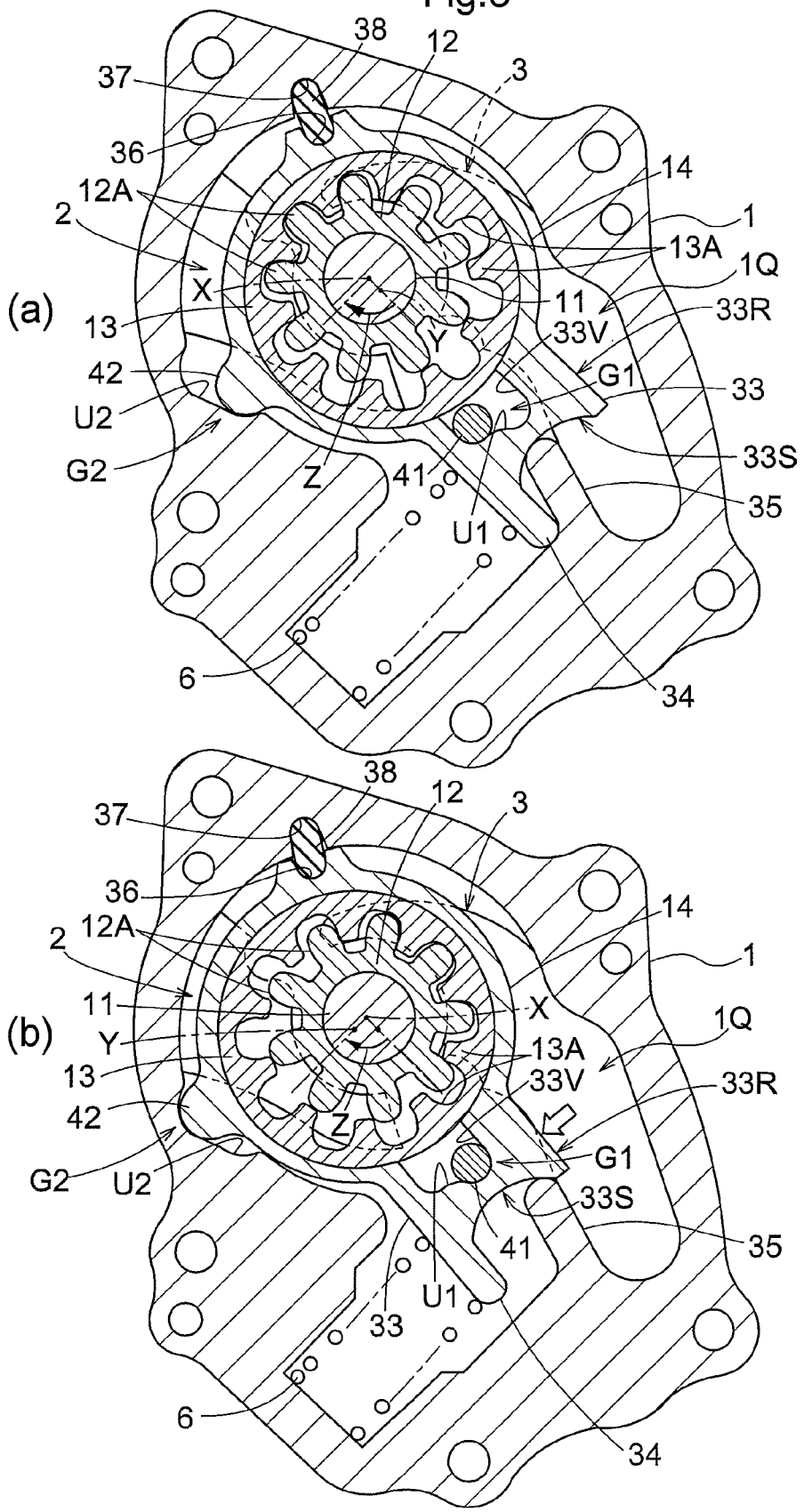
FIGS. 8(*a*) and 8(*b*) show cross-sectional views of the oil pump according to Embodiment 3, FIG. 8(*a*) in a state in which the adjustment ring is at an initial position and FIG. 8(*b*) in a state in which the adjustment ring is moved to the limit.

As shown in FIG. 8, the oil pump of Embodiment 3 is the same as the oil pump in Embodiment 1, in the configurations of the casing 1, the drive shaft 11, the inner rotor 12, and the outer rotor 13. Especially in Embodiment 3, the configuration for actuating the adjustment ring 14 is the same as that described in Embodiment 2, but the configuration of the guide means G is different. It should be noted that the components which are the same as those described in Embodiments 1 and 2 are designated with the same referential characters as in Embodiments 1 and 2.

Specifically, the guide means G is formed of a first guide portion G1 and a second guide portion G2. The first guide portion G1 is formed of: a first guide face U1 formed in a pocket portion 33V of the block portion 33; and a guide pin 41 which projects from the casing in a direction parallel to the drive-rotation axis X. The second guide portion G2 is formed of: a protrusion 42 which protrudes from the outer periphery of the adjustment ring 14 in a direction perpendicular to the drive-rotation axis X; and a second guide face U2 (one example of guide groove) fowled in the casing 1 along the actuation trajectory of the adjustment ring 14 so as to come into contact with the protrusion 42.

Figure 9:
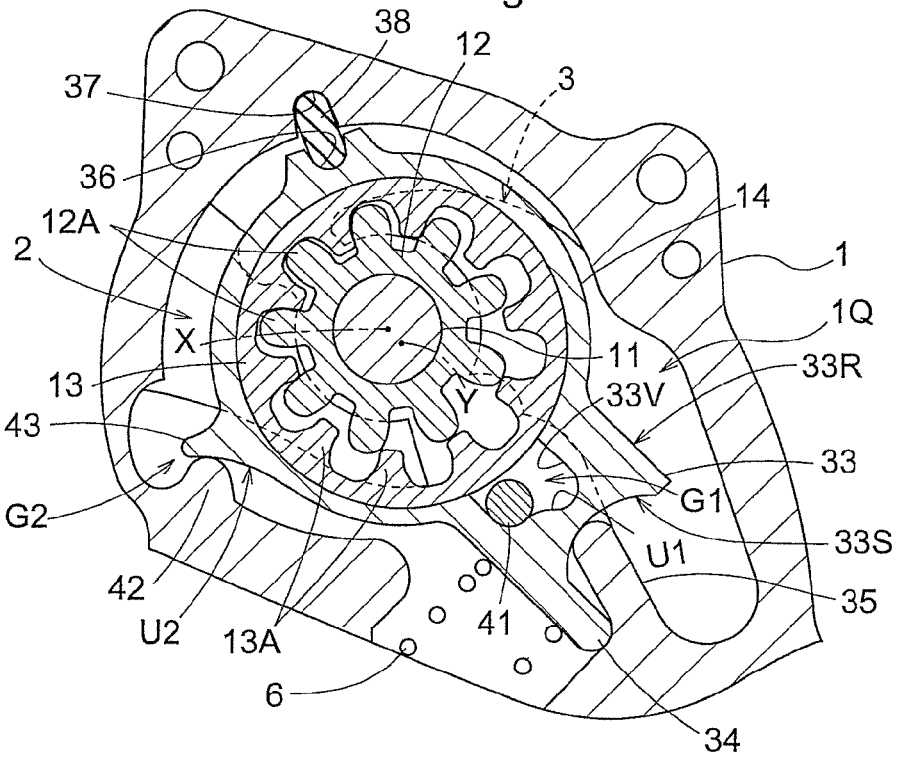
FIG. 9 is a cross-sectional view showing another configuration of a second guide portion of Embodiment 3.
Figure 10:
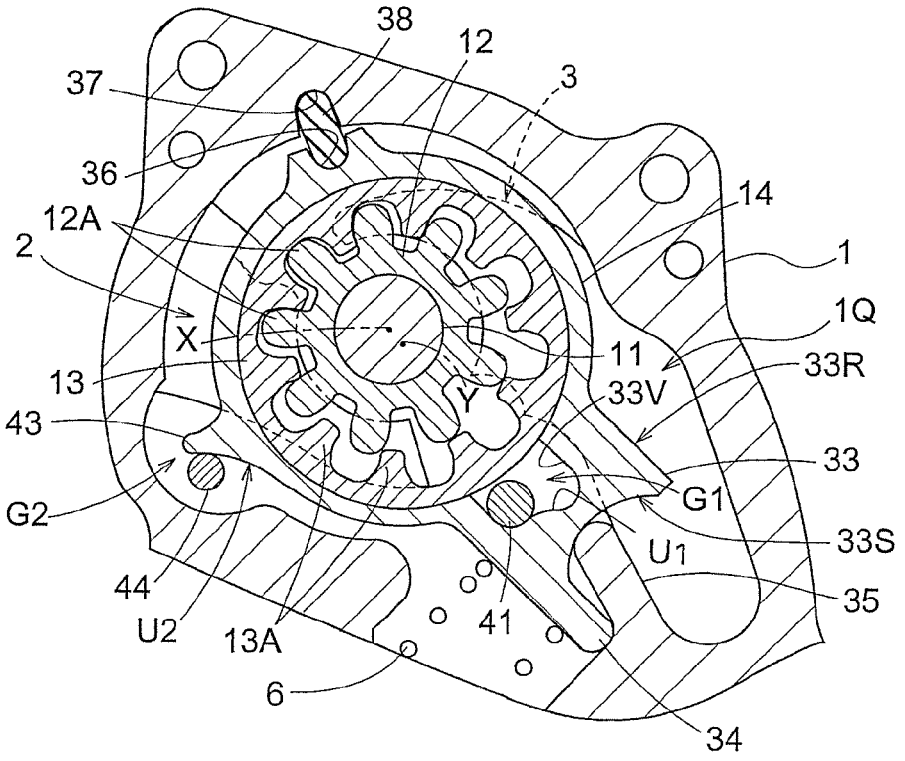
FIG. 10 is a cross-sectional view showing still another configuration of the second guide portion of Embodiment 3.

As shown in FIG. 9, the second guide portion G2 may be formed of: the second guide face U2 formed in a projection 43 provided on the outer periphery of the adjustment ring 14; and the protrusion 42 which projects from the casing 1 so as to come into contact with the second guide face U2. In addition, as shown in FIG. 10, the second guide portion G2 may be formed of: the second guide face U2 formed in the projection 43 provided on the outer periphery of the adjustment ring 14; and a slidably contacting pin 44 which projects from the casing 1 in parallel with the drive-rotation axis X so as to come into contact with the second guide face U2.

As described above, the second guide portion G2 is not limited to those shown in the drawings, and alternatively, various configurations can be selected so as to correspond to abrasion of the member and the shape of the casing 1.

Especially, when the configuration shown in FIG. 8 is adopted for the second guide portion G2, a curvature of the second guide face U2 can be made small and the protrusion 42 can be brought into contact with a wider region. Accordingly, abrasion of the second guide face U2 can be reduced without using a hard material for the casing 1. Likewise, when the configuration shown in FIG. 10 is adopted for the second guide portion G2, a material with high abrasion resistance can be used for the slidably contacting pin 44, and abrasion of the projection 43 with the slidably contacting pin 44 can be reduced.

Figure 11:
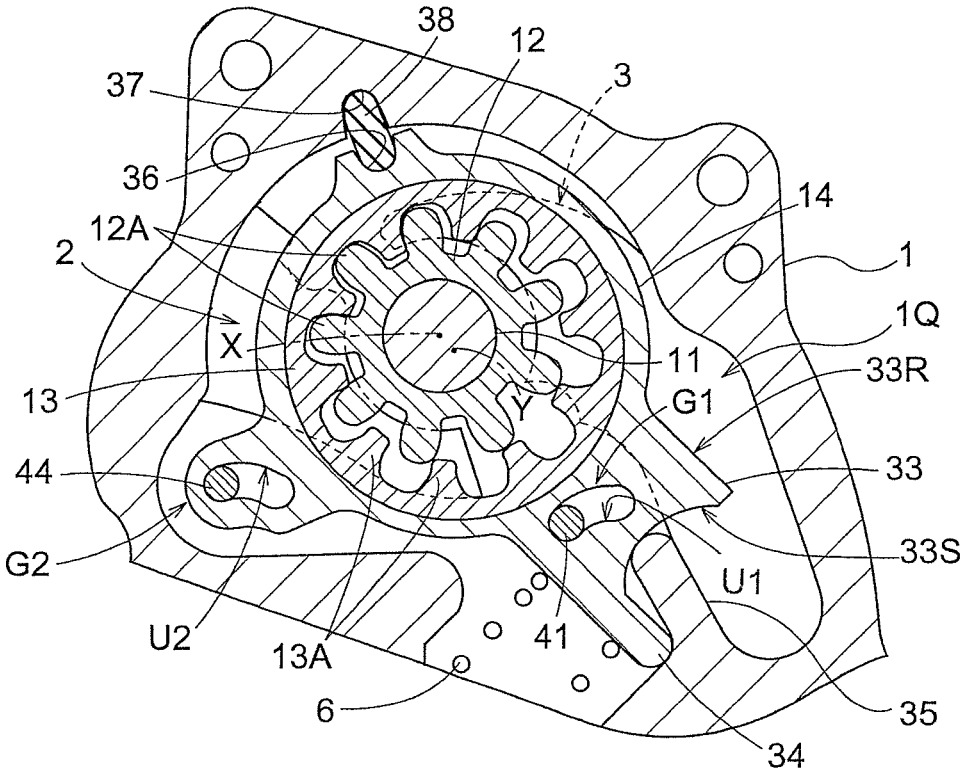
FIG. 11 is a cross-sectional view showing another configuration of first and second guide portions of Embodiment 3.

Descriptions will be made with respect to a case where the configuration shown in FIG. 11 is adopted for the first guide portion G1 and the second guide portion G2. The adjustment ring 14 is provided with the first guide portion G1 and the second guide portion G2 having the first guide face U1 and the second guide face U2, respectively, each guide face having approximately the same shape as the shape of the turning trajectory of the adjustment ring 14. The first guide portion G1 surrounds the guide pin 41, and the second guide portion G2 surrounds the slidably contacting pin 44. With this configuration, oil pressure pulsation or the like acts on the adjustment ring 14, and the positions of the guide pin 41, the slidably contacting pin 44 and the adjustment ring 14 are retained. Therefore, the slidably contacting pin 44 is prevented from moving away from the second guide portion G2.

Embodiment 3 includes a configuration in which a rotational load is reduced, by discharging the oil in the cell R (a space between teeth profiles) formed between the inner rotor 12 and the outer rotor 13, and thus releasing the pressure of the oil trapped in the cell R.

In this type of the oil pump, there happens a phenomenon that oil is trapped in the cell R which is the intermediate region in the outer teeth 12A of the inner rotor 12 and the inner teeth 13A of the outer rotor 13 between the suction inlet 2 and the discharge outlet 3 positioned on the opposite side of the region in which the outer teeth 12A and the inner teeth 13A are engaged most deeply.

Figure 12:
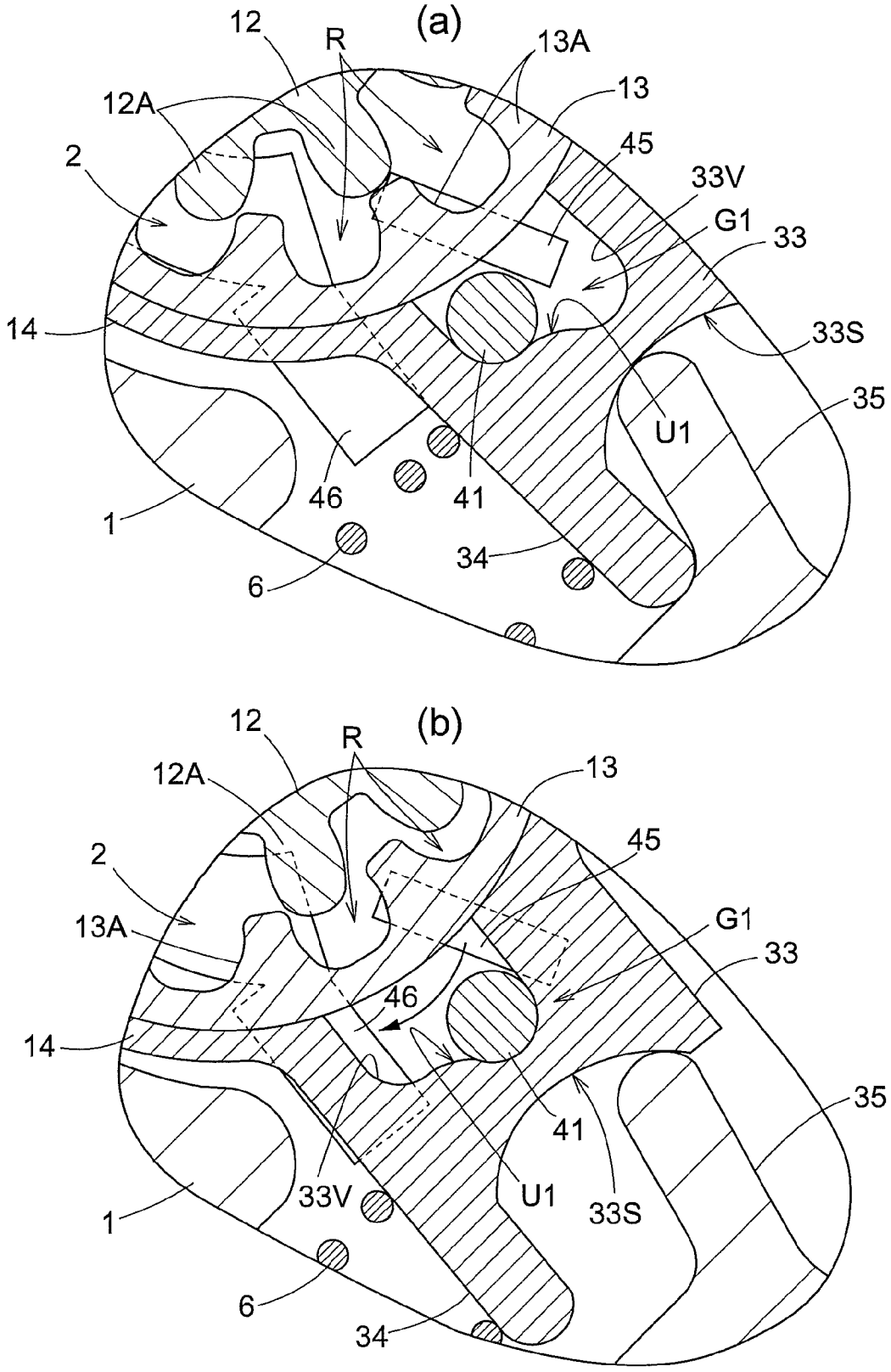
FIGS. 12(*a*) and 12(*b*) show shows enlarged views of a first pressure reduction groove and a second pressure reduction groove, respectively, in Embodiment 3.

Specifically, as shown in FIG. 12, in the intermediate region, a pair of adjacent teeth from among the outer teeth 12A of the inner rotor 12 and a corresponding pair of adjacent teeth from among the inner teeth 13A of the outer rotor 13 are brought into contact, and a state is reached in which the oil is trapped in the cell R as a region enclosed by these teeth.

Since the intermediate region is in a positional relationship in which this region communicates with neither the suction inlet 2 and the discharge outlet 3, a load on the drive shaft 11 is increased at the moment the oil is trapped in the cell R in the intermediate region, which may lead to inconveniences, such as pulsation of the driving system and the oil pump, generation of abnormal noise, and inefficient fuel consumption.

In order to solve these inconveniences, a first pressure reduction groove 45 (one example of communicating groove) configured to release the oil in the cell R to the pocket portion 33V of the block portion 33 is formed in at least one of the two walls of the casing 1. In addition, a second pressure reduction groove 46 (one example of communicating groove) configured to release the pressure in the pocket portion 33V to the suction inlet 2 is formed in at least one of the two walls of the casing 1.

With this configuration, as the rotational speed of the engine is increased, a pressure of the oil in the pressurization space 1Q is increased. In addition, when the pressure of the oil in the pressurization space 1Q is increased, a pressure acting on the pressure receiving face 33R of the block portion 33 is increased, and the adjustment ring 14 is actuated to a position where this pressure and the biasing force of the compression coil spring 6 are balanced.

As described above, by actuating the adjustment ring 14 while guided by the guide means G, even when the rotational speed of the engine is increased, the discharge amount or discharge pressure of oil can be retained at the desired level. As a result, inconveniences can be prevented, such as discharge of an excessive amount of oil, and excessive increase in the discharge pressure, which leads to inefficient fuel consumption.

When the oil pump is actuated and the drive shaft 11 and the inner rotor 12 are rotated; as described above, the oil is trapped in the cell R in the intermediate region. However, the trapped oil is allowed to flow to the pocket portion 33V through the first pressure reduction groove 45, and thus the pressure increase in the cell R can be moderated.

In addition, when the rotational speed of the engine is increased and the adjustment ring 14 is actuated, the pocket portion 33V of the block portion 33 is allowed to communicate with the suction inlet 2 through the second pressure reduction groove 46. Therefore, the oil in the cell R in the intermediate region is allowed to flow to the pocket portion 33V through the first pressure reduction groove 45, and further to the suction inlet 2 from the pocket portion 33V, and thus the pressure increase in the cell R can be suppressed. As a result, pulsation of the driving system and the oil pump as well as generation of abnormal noise can be suppressed, and inefficient fuel consumption of the engine can be suppressed.

<Embodiment 4>

Figure 13:
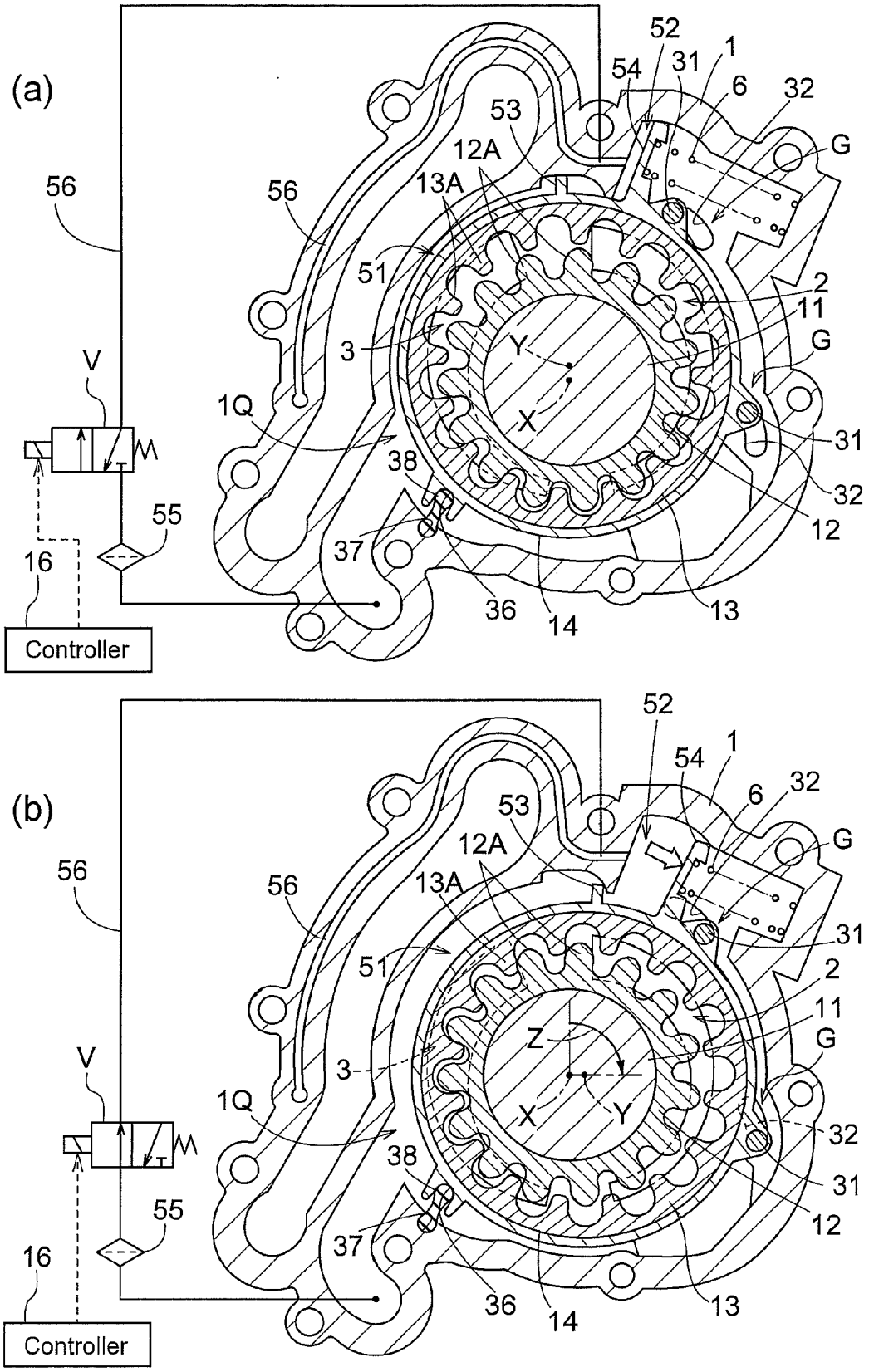
FIGS. 13(*a*) and 13(*b*) show shows cross-sectional views of the oil pump according to Embodiment 4, FIG. 13(*a*) in a state in which the adjustment ring is at an initial position and FIG. 13(*b*) in a state in which the adjustment ring is moved to the limit.

As shown in FIG. 13, the oil pump of Embodiment 4 is the same as the oil pump in Embodiment 1, in the configurations of the casing 1, the drive shaft 11, the inner rotor 12, and the outer rotor 13. Especially in Embodiment 4, the guide means G includes the two guide pins 31 and the two respective guide grooves 32, like in Embodiment 2. However, the configuration for actuating the adjustment ring 14 is different from those in Embodiments 2 and 3. It should be noted that the components which are the same as those in Embodiment 1 are designated with the same referential characters as in Embodiment 1.

Though the arrangements of the guide pin 31, the guide groove 32, and the sealing vane 38 are different from those in Embodiment 2, they have the same functions. In addition, inside the casing 1, the pressurization space 1Q is formed on which discharge pressure from the discharge outlet 3 acts.

Inside the casing 1, there are provided a first pressure chamber 51 on a high-pressure side on which a pressure of the oil in the pressurization space 1Q directly acts, and a second pressure chamber 52 on a low-pressure side on which a pressure of the oil in the pressurization space 1Q acts through the solenoid valve V (one example of control valve). In the outer periphery of the adjustment ring 14, there are provided a first pressure receiving arm 53 (one example of first operation portion or blocking portion) on which a pressure of the oil in the first pressure chamber 51 acts, and a second pressure receiving arm 54 (one example of second operation portion) on which a pressure of the oil in the second pressure chamber 52 acts, which are arranged in a neighboring positional relationship. The second pressure receiving arm 54 has a larger pressure receiving area than the first pressure receiving arm 53 does, and has the compression coil spring 6 on a side opposite to a side on which the pressure of the oil acts.

This oil pump has an oil passage configured to supply oil in the pressurization space 1Q to the solenoid valve V through an oil filter 55, and supply oil from the solenoid valve V to the second pressure chamber 52 through an oil passage 56. The oil passage 56 is formed in a shape of a groove, in at least one of the two casings 1. In the drawing, the oil passage 56 formed in the casing 1 and the oil passage 56 schematically expressed are shown together.

In this oil pump, during the actuation of the adjustment ring 14, a protruding end of the first pressure receiving arm 53 is brought into slidable contact with an inner periphery of the first pressure chamber 51. The oil supplied to the first pressure receiving arm 53 actuates the adjustment ring 14, without causing a leakage. In addition, with this configuration, the first pressure receiving arm 53 functions as blocking portion that prevents a flow of oil between the first pressure chamber 51 and the second pressure chamber 52.

A protruding end of the second pressure receiving arm 54 is also brought into slidable contact with an inner periphery of the second pressure chamber 52. The oil supplied to the second pressure chamber 52 actuates the adjustment ring 14, without causing a leakage.

The controller 16 configured to control the solenoid valve V is formed of an ECU and the like, and controls the solenoid valve V based on information, such as rotational speed of the engine, engine load, and temperature of engine cooling water. Examples of modes of the control include low-pressure control mode and high-pressure control mode.

In the high-pressure control mode, the solenoid valve V is set to a position at which the oil in the pressurization space 1Q is prevented from flowing out, and the second pressure chamber 52 is opened to the atmosphere. Accordingly, a pressure of the oil in the pressurization space 1Q can be allowed to act on the first pressure receiving arm 53, to thereby actuate the adjustment ring 14.

In the low-pressure control mode, the solenoid valve V is set to a position at which the oil from the pressurization space 1Q is allowed to act on the second pressure receiving arm 54 through the oil passage 56. Accordingly, by allowing a pressure of the oil in the pressurization space 1Q to act on the second pressure receiving arm 54, the adjustment ring 14 can be actuated with a lower pressure than the pressure for actuating the adjustment ring 14 in the high-pressure control mode.

As described above, by setting the low-pressure control mode by the controller 16, the actuation can be realized in which the discharge amount of oil from the oil pump can be reduced when the engine rotational speed is low, or the discharge amount of oil from the oil pump can be reduced only when the rotational speed of the engine is high. Accordingly, inconveniences can be prevented, such as discharge of an excessive amount of oil in accordance with the conditions, and excessive increase in the discharge pressure which leads to poor fuel consumption.

<Other Versions of all Embodiments>

(a) The first pressure receiving arm 53 as first operation portion and the second pressure receiving arm 54 as second operation portion which are described in Embodiment 4 may be adopted as the operation portions in Embodiments 1-3. In the case where such operation portions are adopted, it is effective to provide the first pressure receiving arm 53 as a blocking portion as shown in Embodiment 4.

(b) In Embodiment 2, it is described that the gap W is formed between the outer teeth 12A and the inner teeth 13A by the setting of the teeth profile of the outer teeth 12A of the inner rotor 12 and the inner teeth 13A of the outer rotor 13, and that the oil can flow through the gap W. Alternatively, this configuration may be adopted to the oil pump of Embodiments 1, 3 and 4. With this configuration, the oil trapped in the cell R, which is the intermediate region in the outer teeth 12A and the inner teeth 13A between the suction inlet 2 and the discharge outlet 3 positioned on the opposite side of the region in which the outer teeth 12A and the inner teeth 13A are engaged most deeply, can be sent to the suction inlet 2 or the discharge outlet 3, and smooth actuation of the oil pump can be realized.

(c) The first pressure reduction groove 45 and the second pressure reduction groove 46 as communication groove described in Embodiment 3 may be adopted to the oil pump of Embodiments 1, 2 and 4. With this configuration, the oil trapped in the cell R, which is the intermediate region in the outer teeth 12A and the inner teeth 13A between the suction inlet 2 and the discharge outlet 3 positioned on the opposite side of the region in which the outer teeth 12A and the inner teeth 13A are engaged most deeply, can be sent out to the suction inlet 2 or the discharge outlet 3, and smooth actuation of the oil pump can be realized.

Industrial Applicability

The present invention can be utilized in an oil pump driven by an electric motor.

The invention claimed is:

1. An oil pump comprising:

an inner rotor provided in a casing and having outer teeth, the inner rotor being configured to be driven about a drive-rotation axis;

an outer rotor provided in the casing and having more inner teeth than a number of the outer teeth of the inner rotor, the outer rotor being configured to engage with the inner rotor in an eccentric state;

a suction inlet and a discharge outlet configured to suck and discharge a fluid, each provided in the casing so as to face a space between the outer teeth and the inner teeth whose volume is changed in accordance with driven-rotation of the inner rotor; and an adjustment ring provided in the casing, the adjustment ring being coaxially and relatively rotatably fitted on the outer rotor and configured to allow a rotation center of the outer rotor to revolve about a rotation center of the inner rotor, the adjustment ring being provided with an operation portion configured to receive a driving force; and a guide portion which is formed in the adjustment ring and configured to guide the adjustment ring when the operation portion configured to receive a driving force;

wherein the guide portion comprises:

a guide pin and a slidably contacting pin projecting from the casing and arranged in parallel with the drive-rotation axis; and a first guide face provided in a first block portion arranged parallel to the drive-rotation axis and a second guide face provided in a second block portion arranged parallel to the drive-rotation axis, the first block portion and the second block portion, respectively, extending radially outward from an outer circumference of the adjustment ring, the adjustment ring moving about the drive-rotation axis by rotation of the outer rotor eccentrically engaged with the inner rotor while allowing a rotation center of the adjustment ring to revolve about the drive-rotation axis and guided by the guide pin and the slidably contacting guide pin during operation of the oil pump, wherein the first guide face and the second guide face are spaced apart from both of an inner circumferential face and an outer circumferential face of the adjustment ring, wherein the first guide face surrounds the guide pin while the second guide face surrounds the slidably contacting pin, wherein the adjustment ring is supported by a sealing member made of flexible material provided between the casing and the adjustment ring, and wherein when the operation portion receives the driving force, the operation portion moves and the first guide face moves relative to the first guide pin and the second guide face moves relative to the slidably contacting pin.

2. The oil pump according to claim 1, wherein all of a plurality of the spaces between the outer teeth of the inner rotor and the inner teeth of the outer rotor are allowed to communicate with the suction inlet or the discharge outlet.

3. The oil pump according to claim 2, wherein a shape of the outer teeth of the inner rotor and a shape of the inner teeth of the outer rotor are configured to allow all of a plurality of the spaces between the outer teeth and the inner teeth to communicate with the suction inlet or the discharge outlet.

4. The oil pump according to claim 2, wherein the casing is provided with a communicating groove configured to allow a plurality of the spaces between the outer teeth and the inner teeth to communicate with the suction inlet or the discharge outlet.

5. The oil pump according to claim 4, wherein the communicating groove comprises:

a first communicating groove configured to allow the plurality of the spaces to communicate with a pocket portion between the outer rotor and the adjustment ring; and a second communicating groove configured to allow the pocket portion to communicate with the suction inlet.

6. The oil pump according to claim 1, wherein the pump comprises: the inner rotor having (n) of the outer teeth where (n) is a natural number; and the outer rotor having (n+1) of the inner teeth configured to engage with the outer teeth, the rotors of the oil pump are configured to transport the fluid by suction and discharge of the fluid caused by a volumetric change of a cell formed between tooth plane surfaces of the rotors when the rotors are engaged with each other and rotated, a shape of the outer teeth of the inner rotor is obtained by: with respect to a teeth profile formed by a mathematical curve having an addendum circle A1 with a radius RA1 and a root circle A2 with a radius of RA2, deforming a portion of the teeth profile outward of a circle D1 having a radius RD1 satisfying the following Equation (1), to outside in a radial direction, or deforming a portion of the teeth profile inward of a circle D2 having a radius RD2 satisfying the following Equations (2) and (3), to inside in the radial direction:

$$RA1 > RD1 > RA2 \quad \text{Equation (1)}$$

$$RA1 > RD2 > RA2 \quad \text{Equation (2)}$$

$$RD1 \geq RD2 \quad \text{Equation (3).}$$

7. The oil pump according to claim 1, wherein the operation portion is provided in one of the first block portion and the second block portion.

8. The oil pump according to claim 7, wherein a pressurization space, which is surrounded by the adjustment ring, the casing and the sealing member, is formed to allow a discharge pressure from the discharge outlet to act on the block portion having the operation portion.

9. The oil pump according to claim 8, wherein a slidably contacting face is formed in the block portion having the operation portion, and a partition wall is formed in the casing to come into slidable contact with the slidably contacting face at all times during rotation of the adjustment ring.

10. The oil pump according to claim 9, wherein a compression coil spring is contained in a space between the casing and the operation portion, the compression coil spring applying the drive force to the operation portion to move the adjustment ring so as to reduce a volume of the pressurization space.

11. The oil pump according to claim 1, wherein at least a portion of the first guide face configured to contact the guide pin is curved.

12. The oil pump according to claim 1, wherein at least a portion of the second guide face configured to contact the slidably contacting pin is curved.

* * * * *